US005377923A

United States Patent [19]

Matsui et al.

[11] Patent Number: 5,377,923

[45] Date of Patent: Jan. 3, 1995

[54] YARN UNWINDING ASSISTING DEVICE AND YARN UNWINDING METHOD IN AN AUTOMATIC WINDER

[75] Inventors: Isamu Matsui, Kyoto; Yoshiyasu Maeda, Yamatokohriyama; Yuji Todo, Nagaokakyo, all of Japan

[73] Assignee: Murata Kikai Kabushiki Kaisha, Kyoto, Japan

[21] Appl. No.: 905,899

[22] Filed: Jun. 29, 1992

[30] Foreign Application Priority Data

Jul. 1, 1991 [JP] Japan ..... 3-188166
Sep. 19, 1991 [JP] Japan ..... 3-268834
Nov. 6, 1991 [JP] Japan ..... 3-099743[U]

[51] Int. Cl.[6] ..... B65H 49/02; B65H 54/00
[52] U.S. Cl. ..... 242/128; 242/18 R
[58] Field of Search ..... 242/128, 35.6 R, 18 R, 242/35.5 R, 54 R

[56] References Cited

U.S. PATENT DOCUMENTS 5,024,392 6/1991 Uchida et al. ..... 242/128
5,056,727 10/1991 Colli et al. ..... 242/35.6 R
5,106,032 4/1992 Tanigawa ..... 242/128
5,161,749 11/1992 Badiali et al. ..... 242/128

FOREIGN PATENT DOCUMENTS 0475475 3/1992 European Pat. Off. ..... 242/128
0475484 3/1992 European Pat. Off. ..... 242/128
178373 8/1986 Japan ..... 242/128

*Primary Examiner*—Stanley N. Gilreath
*Attorney, Agent, or Firm*—Spensley Horn Jubas & Lubitz

[57] ABSTRACT

A yarn unwinding assisting device for an automatic winder comprising a first defining member having an inner diameter defining portion covered over a yarn feed bobbin to define a lower balloon, and a second defining member having a defining member located above the yarn feed bobbin to define a yarn running area and defining an upper balloon, wherein said first defining member is separated from said second defining member to enable following the unwinding of the yarn feed bobbin.

15 Claims, 22 Drawing Sheets

YARN UNWINDING ASSISTING DEVICE AND YARN UNWINDING METHOD IN AN AUTOMATIC WINDER

BACKGROUND OF THE INVENTION

1. Field of the Invention

The present invention relates to a yarn unwinding assisting device and method in an automatic winder which pieces a yarn of a plurality of yarn feed bobbins produced by a ring spinning machine, for example, and winds a yarn on a cone- or cheese-like winding package while removing defective portions of a slub or the like, and particularly to a yarn unwinding assisting device which enables the implementation of high speed winding.

2. Prior Art

The automatic winder is composed of a plurality of spindles of winding units, and the arrangement of a device for one of the spindles will be described below.

In FIG. 11, a winding unit 1 is fixed in position by a support tube 2 and a duct 3, and a yarn Y drawn from a yarn feed bobbin 4 positioned at a predetermined position of the unit and supplied passes through a balloon breaker 6, a disk- or gate-type tensor 7 for applying a predetermined tension, a slub catcher 8 for detecting a defective portion of the yarn, and the like, after which the yarn is wound on a winding package 14 which is rotated by a traverse drum 13. Reference numeral 15 denotes a splicing device; 16 a suction mouth for guiding an upper yarn on the package side to the splicing device 15; and 17 a relay pipe for guiding a lower yarn on the yarn feed bobbin side. The winding units are each provided with the aforementioned members. A plurality of these winding units 1 are juxtaposed to constitute an automatic winder. The yarn feed bobbin 4 is inserted into an independent tray, 18, under which state, the bobbin 4 is supplied to a winding position A of the winding unit 1 through a supply conveyor 11 and a rotary disk 19. A wound empty bobbin 4' is discharged to a discharge conveyor 12, and a new yarn feed bobbin 4 is instead supplied. A yarn end Y1 is inserted into a hollow portion of a head of the yarn feed bobbin 4 so that the yarn Y of the yarn feed bobbin 4 located at the winding position A is blown up and attracted into the relay pipe 17.

In the winding unit 1, when the slub catcher 8 detects a defective portion of the yarn, an accessory cutter is actuated to cut the yarn. The splicing is carried out when a yarn running signal of the slub catcher 8 is turned OFF. The splicing operation will be described with reference to FIG. 12. In FIG. 12, the suction mouth 16 turns in a direction of ① so that a suction port 16*a* is positioned between the traverse drum 13 and the winding package 14 to such a yarn end of winding package 14. When the suction mouth 16 assumes a predetermined position, the traverse drum 13 or the winding package 14 is reversed by a reversible roller or the reversal of a drive motor within a frame 5 to unwind the yarn, and the yarn end is sucked into the suction mouth 16. Substantially simultaneous with the actuation of the suction mouth 16, the relay pipe 17 turns in a direction of ② to assume a position below the tensor 7. Then, the tensor 7 is opened so that the yarn end unwound from the tensor 7 is sucked into the relay pipe 17. In the change of a bobbin, the yarn blown up from the yarn feed bobbin is sucked into the relay pipe 17. Then, when the suction mouth 16 and the relay pipe 17 having sucked the yarn end on the winding package side and the yarn feed bobbin side are reversely turned and returned to the illustrated position, the yarn enters the splicing device 15 for splicing.

Also when a yarn feed bobbin becomes empty or when a yarn breakage occurs, the aforementioned splicing is carried out with a yarn running signal OFF of the slub catcher 8 as a start point. However, in the event the yarn feed bobbin becomes empty, the splicing operation fails because the lower yarn is not present. Therefore, a yarn feeler 9 is provided at the lower side of the tensor 7 in order to confirm the presence or absence of the lower yarn so that when the yarn feeler 9 does not detect the lower yarn, the bobbin changing is carried out at the same time of the splicing operation. This bobbin changing is carried out by the cooperation between the rotation of the rotary disk 19 (see FIG. 11) and the turning operation of an injection lever (not shown) so that the empty bobbin 4' is discharged, and a new yarn feed bobbin 4 is supplied. Such a lower yarn detecting yarn feeler 9 comprises a mechanical or an optical sensor.

In the aforementioned winding unit 1, a cone- or cheese-like winding package is formed while removing a defective portion such as a slub from the yarn unwound from the yarn feed bobbin and while carrying out the splicing every yarn feed bobbin, and therefore, the productivity greatly depends upon the winding speed. However, in the conventional automatic winder, the practical winding speed is about 1000 m/min. The winding speed has been restricted due to the combination of phenomena (a) to (c) mentioned below. (a) As the winding speed increases, the unwinding tension also increases. Particularly, when the remaining yarn amount on a bobbin is ⅓, referred to herein as a "skinny bobbin", unwinding tension abruptly increases. When this increase becomes large in degree, a yarn breakage caused by the tension occurs. (b) As the winding speed increases, sloughing increases. This sloughing is the state where the yarn is not stably unwound from a chase portion 4*a* of the yarn feed bobbin 4 but the yarn is unwound at a time with some coils are entangled as in an escape through a ring, which comprises a cause of a yarn breakage. (c) As the winding speed increases, fuzz increases.

It has been known in terms of experience that these phenomena (a) to (c) depended on the state of yarn unwinding from the yarn feed bobbin. Therefore, as shown in FIG. 11, a balloon of a yarn unwound from the yarn feed bobbin 4 is restricted by the balloon breaker 6 in the form of a square cone tube to maintain it to be a moderate configuration to prevent the balloon from being excessively widened. However, since the balloon breaker 6 is positioned from the lower side of the guide plate to the upper side of the yarn feed bobbin 4 and secured to the frame 5, as the unwinding of the yarn feed bobbin 4 proceeds, the distance from the chase portion 4*a* of the yarn feed bobbin 4 to the lower end of the balloon breaker 6 gradually becomes lengthened, whereby the function of the balloon breaker 6 likely becomes worsened. In view of this, there is proposed one in which the balloon breaker 6 is formed into a cylindrical shape which is gradually moved down following the release of the yarn feed bobbin.

However, the shape of the conventional balloon breaker has not been so adequate as to compensate the phenomena (a) to (c). As a result, there is a problem in that a practical winding speed of about 1000 m/min. has not been increased.

OBJECT AND SUMMARY OF THE INVENTION

The present invention has been accomplished in view of the above-described problems of the prior art. An object of the present invention is to provide a yarn unwinding assisting device in an automatic winder which can increase the practical winding speed.

Another object of the present invention is to provide a yarn unwinding method comprising defining a balloon of a yarn unwound from a yarn feed bobbin.

Still another object of the present invention is to provide a control method for controlling a yarn unwinding assisting device.

A yarn unwinding assisting device of the present invention comprises a first balloon defining member which is moved down as a yarn feed bobbin is unwound, and a second ballooning defining member having a aperture which is positioned near the top of the bobbin.

Furthermore, according to the present invention, there is provided a yarn unwinding assisting device in an automatic winder comprising a first defining member having an inner diameter defining portion covered over a yarn feed bobbin to define a lower balloon, and a second defining member having a defining member located above the yarn feed bobbin to define a yarn running area and defining an upper balloon, wherein said first defining member is separated from said second defining member to enable following the unwinding of the yarn feed bobbin.

When the lower balloon is defined by the first defining member covered over the yarn feed bobbin following the unwinding, the angle of unwinding from the chase portion is adequately maintained to lessen the sloughing and fuzz. When the upper balloon is defined by the second defining member located above the yarn feed bobbin, the increase of the unwinding tension is suppressed. Further, if the first defining member following the unwinding is separated from the second defining member located above the yarn feed bobbin, it can be easily applied to a long bobbin. For example, when the second defining member is secured to the first defining member, the height of the winding unit becomes greater than the height of the long bobbin.

DETAILED DESCRIPTION OF PREFERRED EMBODIMENT

Figure 1:
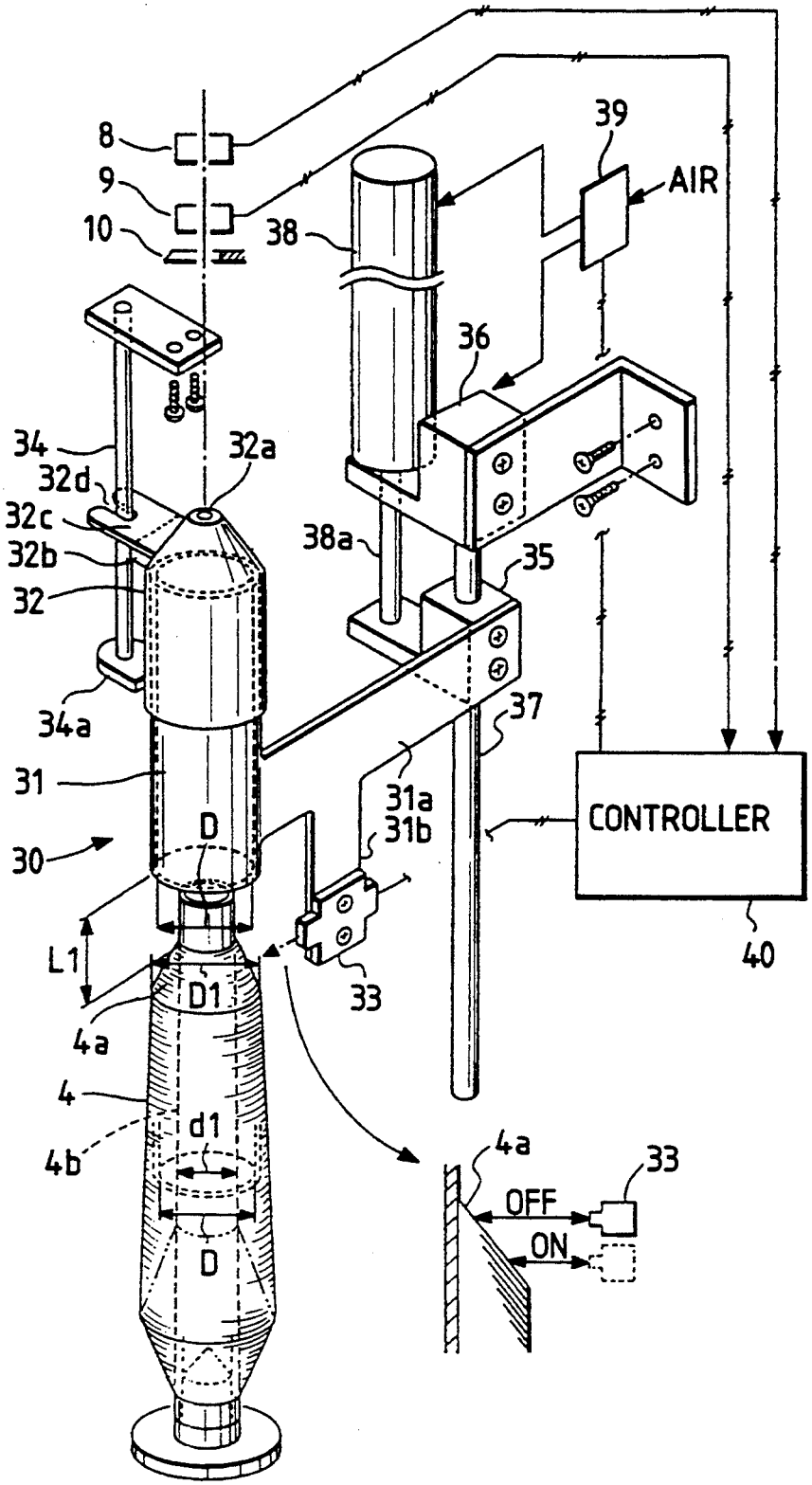
FIG. 1 is a perspective view of an unwinding assisting device according to the present invention.

Embodiments of the present invention will be described hereinafter with reference to the drawings. FIG. 1 is a perspective view showing a yarn unwinding assisting device according to the present invention.

In FIG. 1, an unwinding assisting device 30 principally comprises a tubular body 31 as a first defining member, a tubular body 32 with an aperture as a second defining member, and a sensor 33, a cylinder 38 and a controller 40 as a follow mechanism.

The tubular body 31 as the first defining member is open in upper and lower portions thereof and has a first arm 31*a* wherein an elevating block 35 is mounted on the side of the tubular body 31. The elevating block 35 is vertically slidably inserted into a rod 37 suspended from a fixed block 36 and is connected to a piston rod 38*a* of the cylinder 38 stood upright on the fixed block 36. The tubular body 31 can be vertically moved according to the expansion of the rod 38*a* of the cylinder 38. This tubular body 31 may be gradually moved down so that a distance L1 from the chase portion 4*a* of the yarn feed bobbin 4 is substantially constant to be covered over a core tube 4*b* of the yarn feed bobbin 4. The spreading of the balloon (the lower balloon with respect to the tubular body 31) of the yarn unwound from the chase portion 4*a* is adequately maintained to thereby enlarge the angle of unwinding, thus suppressing the sloughing and fuzz.

In order to fully perform the function of the tubular body 31 as described above, there is a preferred relationship between the dimension of an inner diameter defining portion which is the lower end of the tubular body 31 and the diametral dimension of the yarn feed bobbin 4. The inner diameter D of the lower end of the tubular body 31 for controlling the balloon of the yarn unwound from the chase portion 4 is preferably smaller than the outer diameter of the yarn layer of the yarn feed bobbin 4 and larger than the outer diameter of the core tube 4*b*. Generally, the core tube 4*b* and the yarn layer of the yarn feed bobbin 4 have a conical shape, the yarn layer has in its upper side a minimum outer diameter D1, and the outer diameter of the core tube 4*b* has at the lowermost position (indicated by the phantom line) of the tubular body 31 a diameter d1 larger than the top. Therefore, the inner diameter D of the tubular body 31 is smaller than D1 but larger than d1. Preferably, the inner diameter D of the tubular body 31 is as close possible to d1. As will be described later, the effect resulting from the gradual downward movement of the tubular body 31 is effective up to the point that the bobbin defines a skinny bobbin, and even if the tubular body 31 is further lowered or not lowered, there is no difference in the degree of the effect. Accordingly, preferably, the lowermost position of the tubular body 31 is set to the position indicated by the phantom line in the vicinity of the skinny bobbin determined by the length of the piston rod 38*a* of the cylinder 38, so that there is preferably a clearance of between approximately 2 to 3 mm between the inner diameter D of the tubular body 31 and the outer diameter D1 of the core tube.

The tubular body 32 with an aperture as the second defining member is inserted on the outer periphery of the tubular body 31 as the first defining member. Accordingly, the tubular body 32 with an aperture moves down as the tubular body 31 gradually moves down. However, the tubular body 32 with an aperture has an arm 32*c* with a slit 32*d* mounted thereon, and a magnet 32*b* is attached to the lower side of the arm 32*c*. The slit 32*d* is guided by a stopper shaft 34, and when the magnet 32*b* and the arm 32*c* impinge on a plate 34*a* at the lower end of the stopper shaft 34, the downward movement of the tubular body 32 with an aperture stops. That is, at the time of the skinny bobbin at which the yarn tension begins to materially increase, the downward movement of the tubular body 32 with an aperture stops, and the aperture 32*a* assumes a position immediately above the take-up tube 4*b*. This aperture 32*a* has a function to define a yarn running area to prevent a large variation of a balloon (an upper balloon) from the tubular body 31 to the guide plate 10 to narrow the variation width of yarn tension.

In order to effectively perform the function of the aperture 32*a* as described above, the position and shape of the aperture 32*a* which defines the yarn running area are important. It is preferable for the aperture 32*a* to assume a position 4 to 180 mm from the top of the take-up tube 4*b*. When it is less than 4 mm, the aperture 32*a* is excessively close to the take-up tube 4*b*, resulting in an unnaturalness of the yarn running area. When it exceeds 180 mm, the aperture 32*a* is too remote from the take-up tube 4*b* define the upper balloon. The inner diameter of the aperture 32*a* is less than the outer diameter of the top of the take-up tube 4*b* and preferably 2 mm or more. When exceeding the outer diameter of the top of the take-up tube 4*b*, it will not serve to define the yarn running area, and when it is less than 2 mm, there occurs a trouble in blowing the yarn upward. The aperture of inner diameter 4 to 6 mm is preferred. Further, since the tubular body 32 witch an aperture is divided from the tubular body 31 and the tubular body 31 is inserted into the tubular body 32 with an aperture, the total height of the tubular body 31 and the tubular body 32 with an aperture is low in the standby position indicated by the solid line. Accordingly, even a long bobbin wherein the height of the yarn feed bobbin 4 is high, the spacing from the top of the take-up tube 4 to the guide plate 10 can be shortened. The use of the unwinding assisting device 30 eliminates the need to increase the height of the back of the whole winding unit.

Next, the sensor 33, the cylinder 38 and the controller 40 as the follow mechanism will be described below.

The sensor 33 mounted on a second arm 31*b* of the tubular body 31 detects the chase portion 4*a* of the yarn feed bobbin 4, the controller 40 receiving an input of the sensor 33 causes a switching valve 39 to be actuated, and the piston rod 38*a* of the cylinder 38 gradually extends to maintain a distance L1 between the tubular body 31 and the chase portion 4*a* at substantially constant. As the sensor 33, a diffusion reflective sensor is used. A light source composed of an LED is arranged to cross with or parallel with a detector composed of a photo transistor or a photo diode so that one wherein light from the light source is diffused by a member to be detected and reflected thereby is detected by a detector. As shown, when the unwinding of the chase portion 4*a* proceeds, the distance from the sensor 33 to the chase portion 4*a* increases, and the sensor 33 soon issues an OFF signal. Upon reception of this OFF signal, the controller 40 causes the piston rod 38*a* of the cylinder 38 to be extended through the switching valve 39. Then, the distance from the sensor 33 to the chase portion 4*a* becomes short, and the sensor 33 soon issues an ON signal. Upon reception of this ON signal, the controller 40 stops the piston rod 38*a* of the cylinder 38 through the switching valve 39. By this repetition, the tubular body 31 gradually moves down as the unwinding proceeds. It is to be noted that the sensor 33 for monitoring the chase portion 4*a* is not limited to be mounted in a horizontal direction but can be mounted at a suitable angle from a position immediately above the chase portion 4*a* to the horizon.

Figure 2:
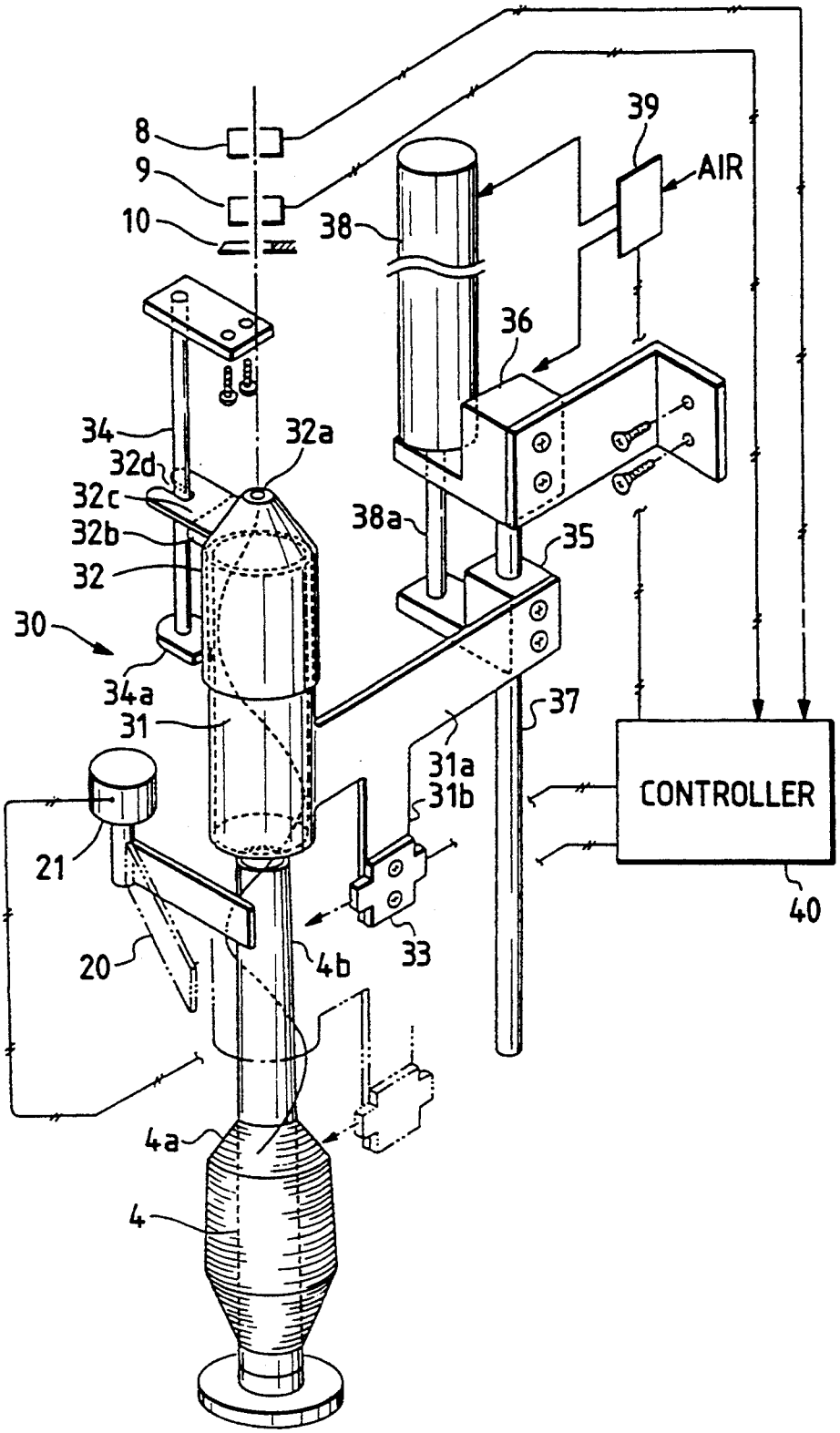
FIG. 2 is a perspective view showing the operating state of the unwinding assisting device according to the present invention.

Further, the devices in connection with the movement of the unwinding assisting device 30 will be described. Reference numeral 8 denotes a slub catcher; 9 a yarn feeler; 20 a lever; and 21 a pivot drive portion of the lever 20. As the slub catcher 8, for example, a device for measuring a variation of electrostatic capacity is used to detect not only a defect of yarn but whether or not the yarn is running. When the slub catcher 8 does not issue a yarn running signal, the piecing operation is carried out. In this case, the lower yarn unwound from the tensor is held on the relay pipe but when the relay pipe turns from the bottom to the top, a kink possibly occurs in the yarn unwound from the yarn feed bobbin. To unwind the yarn in which the kink is liable to occur, the lever 20 as a kink occurrence preventive device is provided as shown in FIG. 2. This lever 20 moves from a retreated position indicated by the phantom line to the actuated position indicated by the solid line (the state in contact with the side of the take-up tube 4*b* ). A tension is applied by the lever 20 to the lower yarn every rotation of the yarn unwound from the chase portion 4*b* to prevent the kink. For the operation of the lever 20 as the kink occurrence preventive device, the tubular body 31 and the tubular body 32 with an aperture of the unwinding assisting device 30 assume the retreated position indicated by the solid line. It is to be noted that the actuation of the lever 20 can be done by the mechanical operation as a part of the splicing operation without using the independent turn drive portion. In the case where the slub catcher 8 does not issue the yarn running signal and the yarn feeler 9 does not detect the yarn, the yarn feed bobbin 4 is an empty bobbin and the bobbin changing is carried out. In this case also, the tubular body 31 and the tubular body 32 with an aperture of the unwinding assisting device 30 assume the retreated position indicated by the solid line, and when a new yarn feed bobbin 4 assumes a predetermined position, the lever 20 shifts from the retreated position indicated by the phantom line to the actuation position indicated by the solid line, and the splicing is carried out while preventing the occurrence of the kink.

Figure 3A:
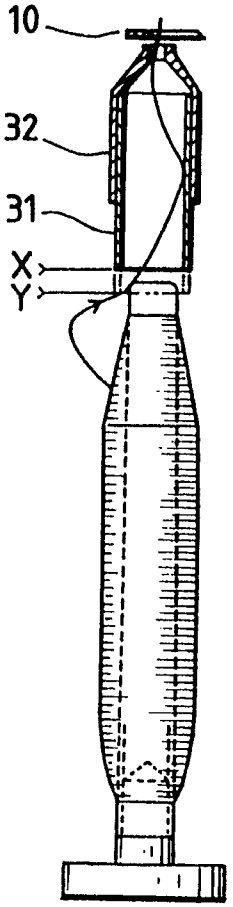
FIGS. 3*a*–3*d* are side views showing a yarn unwinding method according to the unwinding assisting device of the present invention.
Figure 3B:
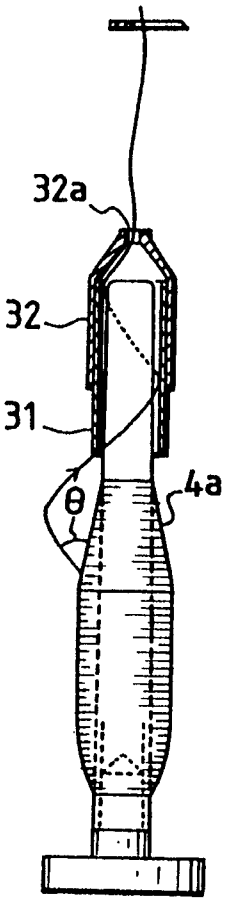
Figure 3C:
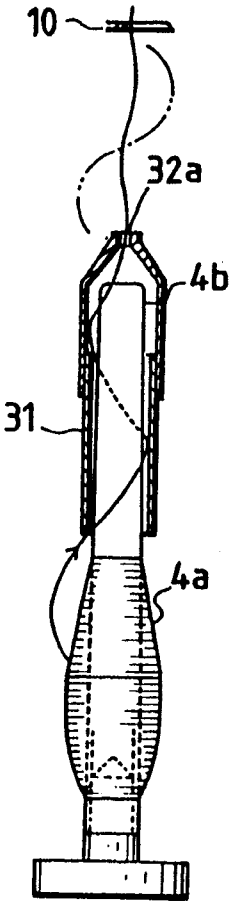
Figure 3D:
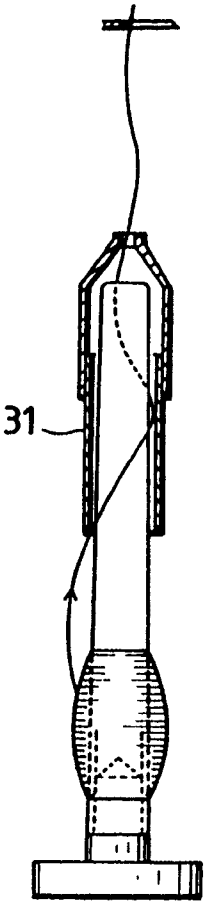

Next, the yarn unwinding method by the aforementioned unwinding assisting device 30 will be described with reference to FIGS. 3*a*-3*d*. FIGS. 3*a* to 3*d* are views showing how the tubular body 31 and the tubular body 32 with an aperture follow the unwinding. In FIG. 3*a*, the tubular body 31 and the tubular body 32 with an aperture are at the retreated position X. At this retreated position, the inner diameter defining portion at the lower end of the tubular body 31 is located above the take-up tube 4*b* and the supplying of a new yarn feed bobbin after the ejection of an empty bobbin is carried out. As indicated by the phantom line, the inner diameter defining portion at the lower end of the tubular body 31 moves down to the actuation state in which it covers over the take-up tube 4*b*. Y designates an actuating position. FIG. 3*b* shows the state of a partial bobbin, in which both the tubular body 31 and the tubular body 32 with an aperture move down, and the aperture 32*a* assumes a predetermined position. Particularly, the tubular body 31 moves down so as to follow the unwinding of the chase portion 4*a* so that the angle of unwinding $\theta$ of the yarn unwound from the chase portion 4*a* is maintained large and the rubbing between the yarn remaining on the yarn feed bobbin and the yarn to be unwound is lessened, as a result of which the occurrence of sloughing and fuzz is suppressed. FIG. 3*c* shows the state of a skinny bobbin, in which only the tubular body 31 moves down whereas the tubular body 32 with an aperture remains stopped, and the aperture 32*a* is at a predetermined position immediately above the take-up tube 4*b*. Particularly, on unwinding from lesser yarn amount bobbin than the skinny bobbin, the tension of unwinding tends to abruptly increase. A large balloon as indicated by the phantom line appearing in the yarn unwound from the bottom of the chase portion 4*a* and a small balloon appearing in the yarn unwound from the top of the chase portion 4*a* alternately appear. However, due to the presence of the aperture 32*a* the upper balloon from the aperture 32*a* to the guide plate 10 is limited to a small balloon, and when the yarn being unwound is less than the amount of yarn on the skinny bobbin, the shape of the chase portion 4*a* begins to gradually become uneven. Even if the tubular body 31 is further lowered, there occurs no difference in the suppression effect of the sloughing and fuzz. Therefore, as shown in FIG. 3*d*, in the unwinding after the skinny bobbin, the tubular body 31 does not follow the unwinding but remains stopped at a predetermined position. That is, it is necessary for the inner diameter defining portion at the lower end of the tubular body 31 to move down following the unwinding from the beginning of the unwinding to forming of the skinny bobbin, and for the aperture 32*a* of the tubular body 32 with an aperture to stop at a predetermined position immediately above the take-up tube 4*b* from the formation of the skinny bobbin to the termination of the unwinding. Because the tubular body 31 and the aperture 32*a* do not necessarily move and stop at identical times, the device is divided into a first defining member and a second defining member, with each defining member being capable of moving and stopping substantially independently of the other defining member.

Figure 4A:
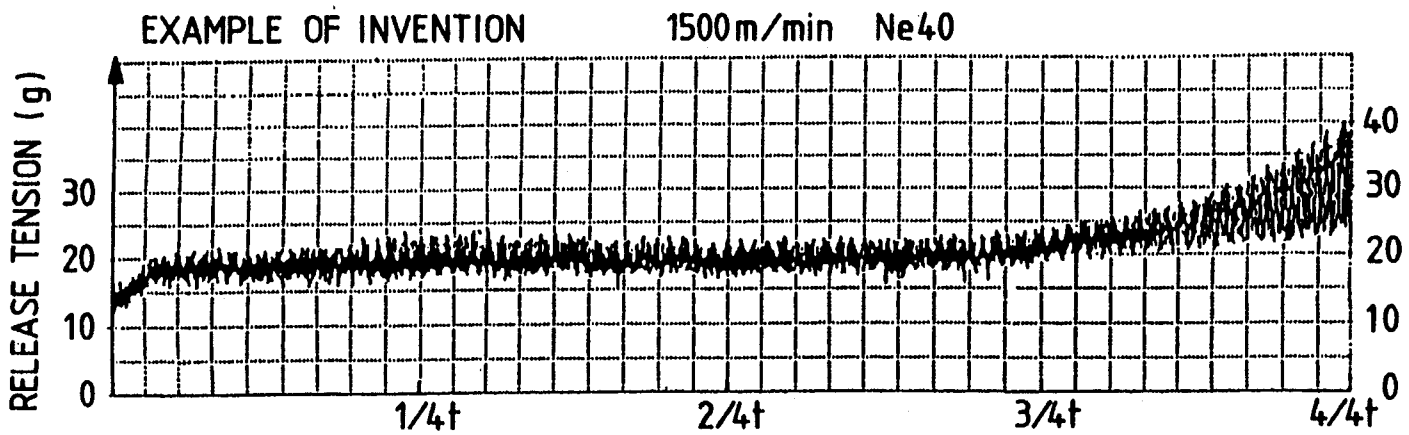
FIGS. 4*a* and 4*b* are graphical illustrations showing a variation of unwinding tension.
Figure 4B:
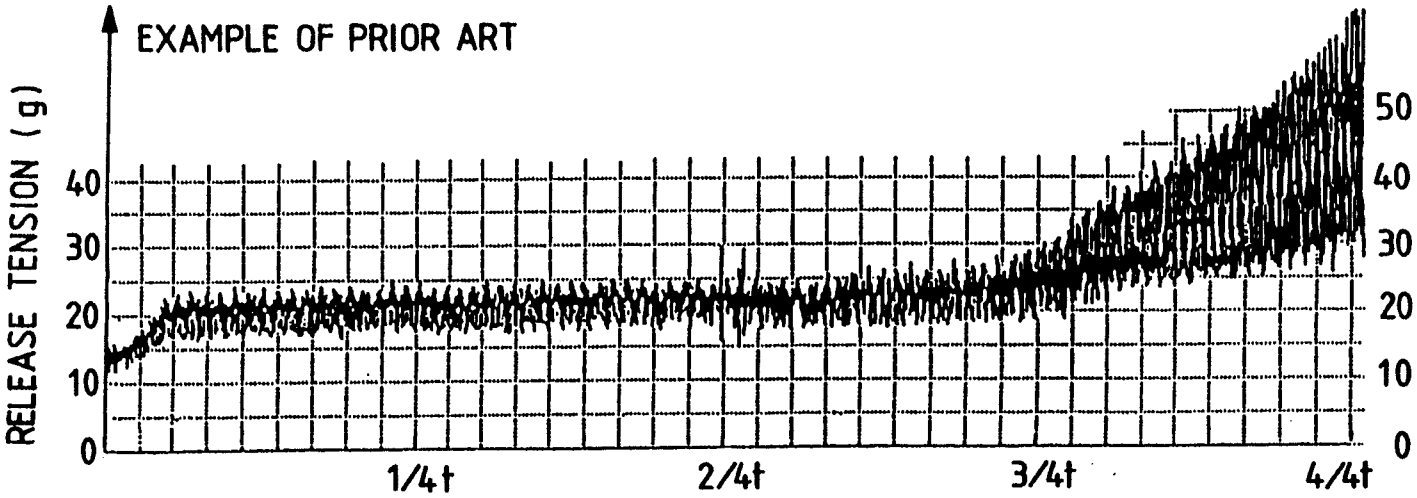

The specific example of the effect of the aforementioned unwinding assisting device will be described with reference to FIGS. 4*a* to 6. FIGS. 4*a* and 4*b* are views showing the passage of time of the unwinding tension. FIG. 4*a* shows the case where the unwinding assisting device of the present invention is used, and FIG. 4*b* shows the case where the conventional fixed square cone tube is used. A yarn feed bobbin on which a yarn of cotton 100% and Ne40 is wound was unwound at 1500 m/min. In FIG. 4*b* showing the conventional example, the unwinding tension increases while being greatly varied from the neighbourhood of the skinny bobbin. It increases to 50 g finally with respect to a mean unwinding tension 20 g, and a range of variation is 30 g. In the present example, the increase of the unwinding tension appears but it gradually increases. The unwinding tension finally increases to 35 g with respect to a mean unwinding tension 20 g, and the range of variation is 15 g. The degree of the increase was reduced to one half in the range of variation as compared with the prior art.

Figure 5:
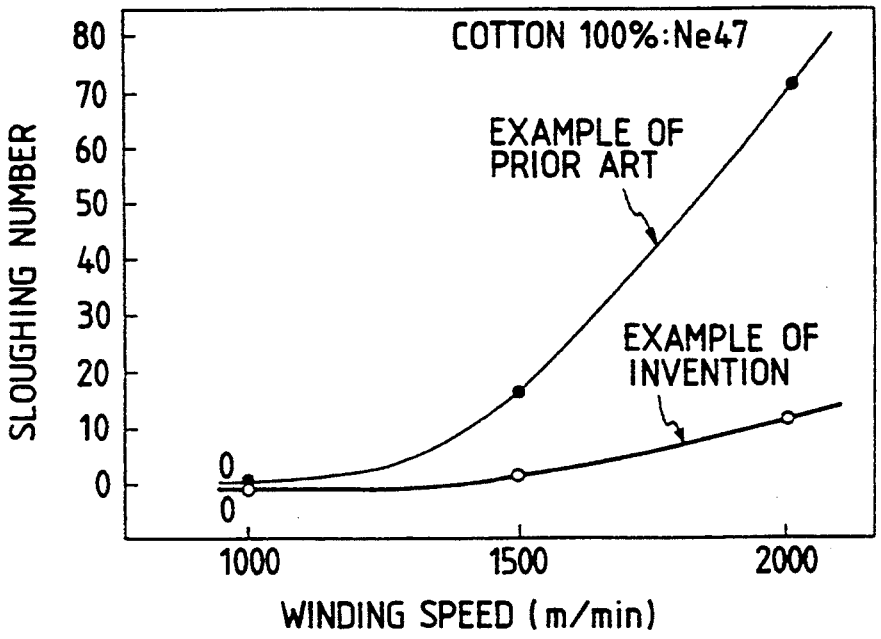
FIG. 5 is a graphic representation showing the relationship between the winding speed and the number of sloughing.

FIG. 5 is a view showing the relationship between the winding speed and the sloughing number. A yarn feed bobbin on which a yarn of cotton 100% and Ne47 is wound was used, and the sloughing time occurring during one yarn feed bobbin is unwound was observed with respect to 12 yarn feed bobbins, of which mean values are shown. In the prior art, when the winding speed exceeds 1000 m/min., the sloughing number begins to increase. At 1500 m/min., about 20 times of sloughing occur, and a yarn breakage often occurs due to the mutual action of the increase and variation of the unwinding tension shown in FIG. 4, failing to achieve the practical continuous operation. In the present example, the sloughing number begins to increase from the neighborhood of 1300 m/min. of the winding speed, and at 1500 m/min. several sloughings occur. Accordingly, in the continuous operation at 1300 m/min. at which sloughing hardly occurs, yarn breakage does not increase.

Figure 6:
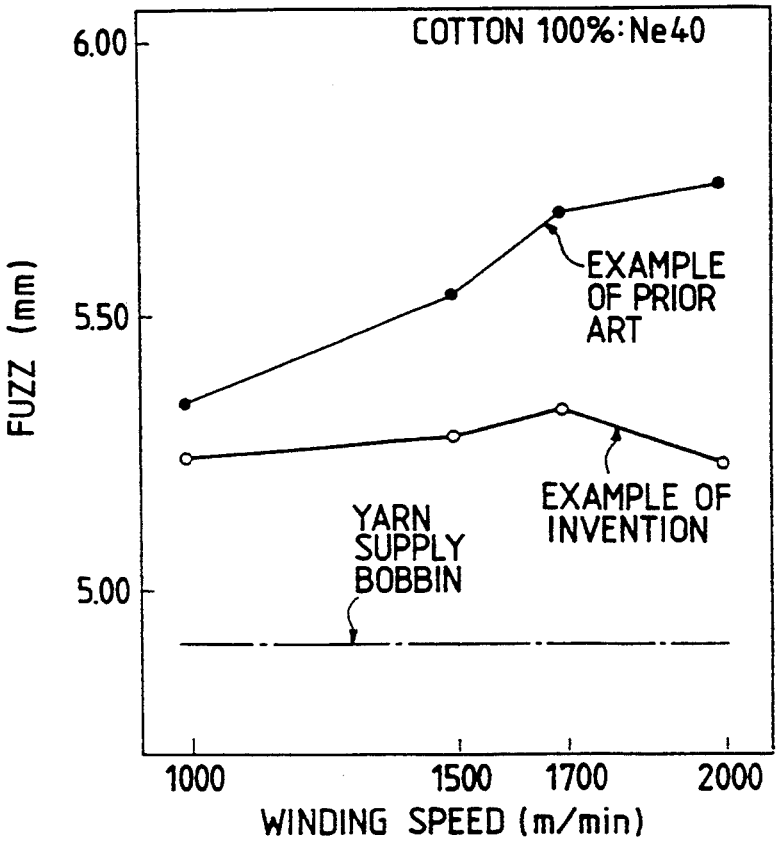
FIG. 6 is a graphic representation showing the relationship between the winding speed and fuzz.

FIG. 6 is a view showing the relationship between the winding speed and the fuzz. Similarly to FIG. 4, a yarn feed bobbin on which a yarn of cotton 100% and Ne40 is wound was used. The unit of fuzz is mm, showing the overall length of the fuzz appearing in a sample yarn of 1 cm. The fuzz of the yarn feed bobbin before winding is slightly below 5.00. In the conventional example, the fuzz increases as the winding speed increases. In the present example, even if the winding speed increases, the degree of the increase of the fuzz is extremely low and is considerably reduced as compared with the prior art. That is, even if the yarn is wound at 1300 m/min. well over 1000 m/min. of prior art, the amount of fuzz does not increase.

The aforementioned unwinding assisting device follows the unwinding by way of the vertically movable tubular body by the sensor but need to assume the retreated position at the time of splicing as shown in FIG. 2. A separate movement independent of the sensor 33 is desired. So, the efficient movement of the tubular body without lowering the winding efficiency will be described below. In FIG. 2, when a yarn running signal (a signal representative of the fact that winding is normally carried out) from the slub catcher is turned OFF, a series of splicing operations start. With the OFF of the yarn running signal as a start point, the tubular body 31 and the tubular body 32 with an aperture of the unwinding assisting device 30 are quickly moved up to the retreated position indicated by the solid line irrespective of the output of the sensor 33. That is, the series of splicing operations and the upward movement of the tubular body 31 and the tubular body 32 with an aperture are simultaneously carried out. And, a series of splicing operations (including the operation of the lever 20) are carried out. When the splicing succeeded and the yarn begins to be wound, the yarn running signal from the slub catcher 8 is changed into ON. With the ON of the yarn running signal as a start point, the tubular body 31 and the tubular body 32 with an aperture shifts to the normal downward operation and the output of the sensor 33 is switched from OFF to ON. The tubular body 31 then stops. When the unwinding assisting device is actuated with the OFF or ON of the yarn running signal from the slub catcher 8 as a reference, waste of the movement of the tubular body 31 disappears.

The winding speed after the splicing is gradually increased to a predetermined winding speed. The degree of the increase in speed varies with the controller 40 of the winding unit. In the case where the increase in the winding speed is quick, there is a fear that the downward movement of the tubular body 31 is delayed and the yarn breakage occurs. It is therefore preferred that the downward speed of the tubular body 31 is associated with the degree of the increase in speed of winding (for example, the controller 40 of the winding unit is programmed in advance so that when the increase in winding speed is quick, the downward speed of the tubular body 31 is also quick), to move downward the tubular body 31 to a predetermined position till it reaches a dangerous winding speed at which occurrence of a yarn breakage is expected.

In the case of a yarn for which kink is hard to occur, the lever 20 as the kink occurrence preventive device shown in FIG. 2 is not always actuated. At this time, the tubular body 31 and the tubular body 32 with an aperture will suffice to be moved upward to the retreated position only at the time of changing a bobbin. The tubular body 31 and the tubular body 32 with an aperture can be moved upward to the retreated position with a lower yarn-absence signal, as a reference, of the yarn feeler 9 detected in the initial stage of the splicing operation which is started by the OFF of the yarn running signal of the slub catcher 8.

Figure 7:
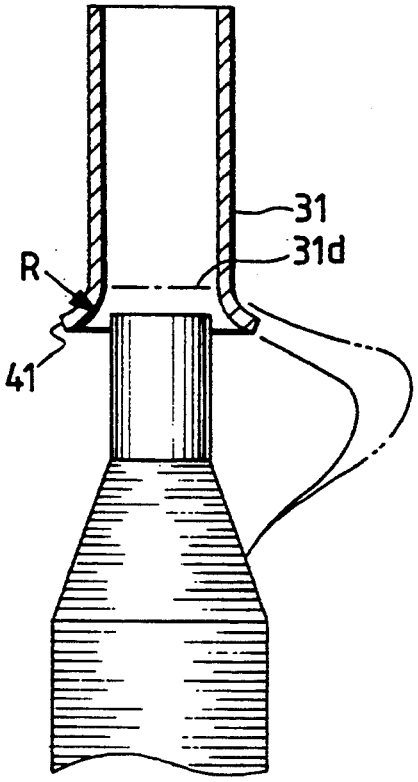
FIG. 7 is a sectional view showing a further embodiment of a first defining member.

FIG. 7 shows a further preferred embodiment of the tubular body as the first defining member. An umbrella-like enlarged portion 41 is mounted below the inner diameter defining portion 31*d* of the tubular body 31. This enlarged portion 41 is necessary to smoothly continue to the inner diameter defining portion 31*d*, and the radius of curvature of the tubular body 31 is selected to be 3 mm or more. By the provision of the enlarged portion 41, the running of the yarn at the inner diameter defining portion 31*d* of the tubular body 31 becomes smooth to further suppress the occurrence of fuzz. Further, in the unwinding of a yarn having a large count, the lower balloon tends to be inflated outwardly as shown by the phantom line due to a large centrifugal force, as a consequence of which the balloon tends to be unstable. However, an excessively large lower balloon is defined to an adequate inflation by the provision of the enlarged portion 41, and the balloon is stabilized.

Figure 8:
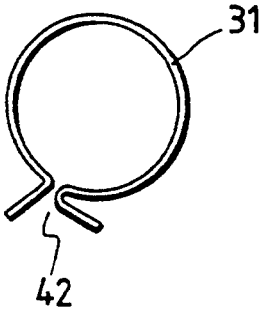
FIG. 8 is a sectional view showing another embodiment of the first defining member.
Figure 11:
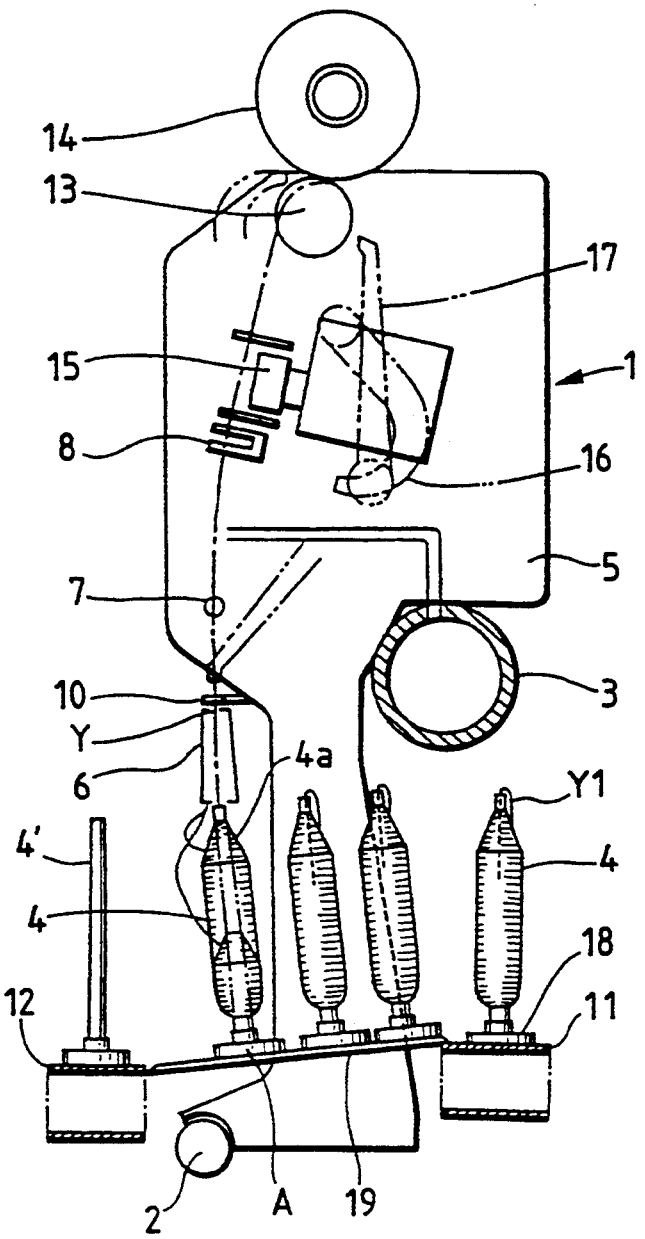
FIG. 11 is a view showing a side view of an arrangement of devices of the winding unit.
Figure 12:
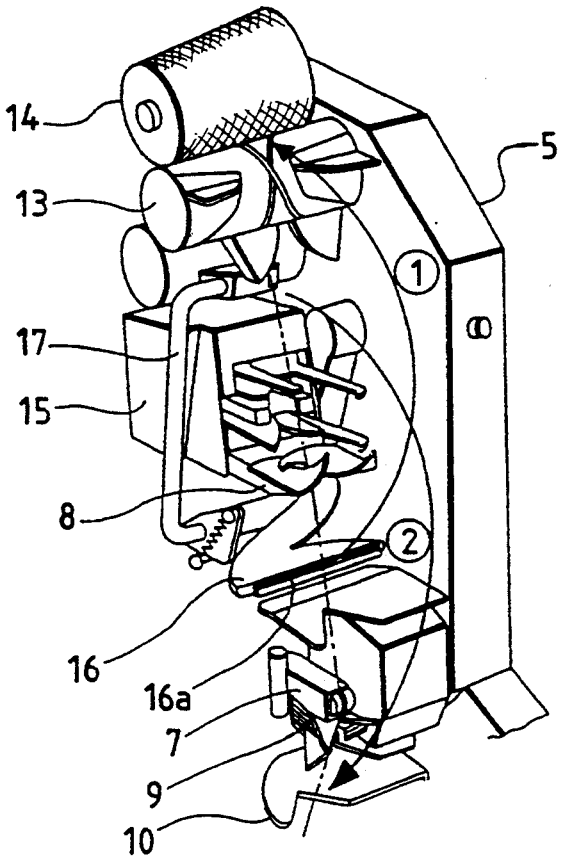
FIG. 12 is a perspective view of essential parts of the winding unit.

FIG. 8 shows another embodiment of the tubular body as the first defining member. There is not only an automatic winder shown in FIG. 11 in which in changing a bobbin, a yarn feed bobbin 4 is inserted into an independent tray 18, under which state the bobbin is transferred and supplied to the winding unit for winding and discharging it, but also an automatic winder having a magazine in which each unit stores therein a plurality of bobbins. In this automatic winder having a magazine, the yarn feed bobbin is supplied while drawing a yarn from the top, and the yarn can be threaded from the slit 42. In this manner, the tubular body need not always be provided with a circumferentially continuous side wall.

Figure 9A:
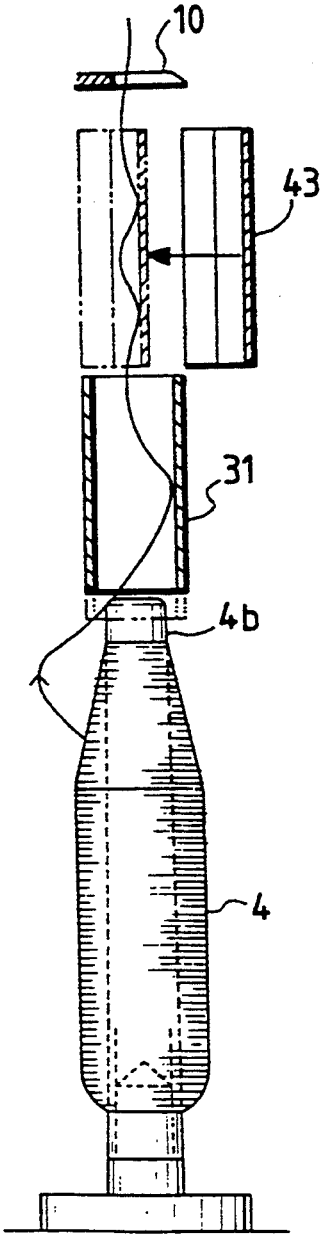
FIGS. 9*a*–9*c* are sectional views showing a further embodiment of the second defining member.
Figure 9B:
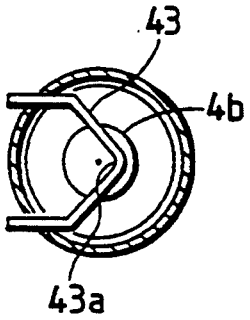
Figure 9C:
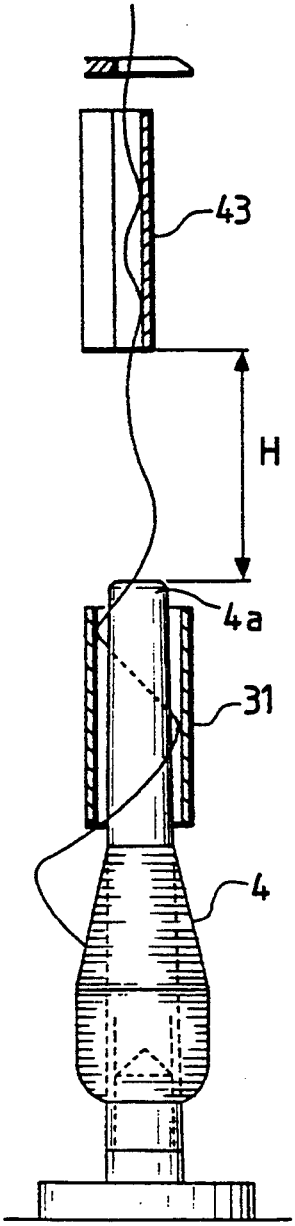

FIGS. 9*a*–9*c* show another embodiment of the second defining member. In FIG. 9*a*, the yarn feed bobbin has a normal length, and there is enough distance from the take-up tube 4*b* to the guide plate 10. Above the retreated position of the tubular body 31 as the first defining member is provided a triangular plate 43 as the second defining member so that it can be moved in a horizontal direction. Before threading, the triangular plate 43 is at the retreated position indicated by the solid line whereas after completion of threading, it advances to the actuation position indicated by the phantom line. As shown in FIG. 9*b*, an inner corner 43*a* of the triangular plate 43 is within the outer diameter of the take-up tube 4*b* and can define the yarn running area. As shown in FIG. 9*c*, only the tubular body 31 moves down, and the triangular plate 43 remains stopped at the actuation position. Also in this case, the height H from the top of the take-up tube 4*b* to the triangular plate 43 is preferably 180 mm or less. When the height exceeds 180 mm, a free portion after the yarn feed bobbin 4 becomes excessively long, and the upper balloon is unsufficiently defined. A U-groove plate or two parallel plates can be used in place of the triangular plate 43 as the second defining member.

Figure 10A:
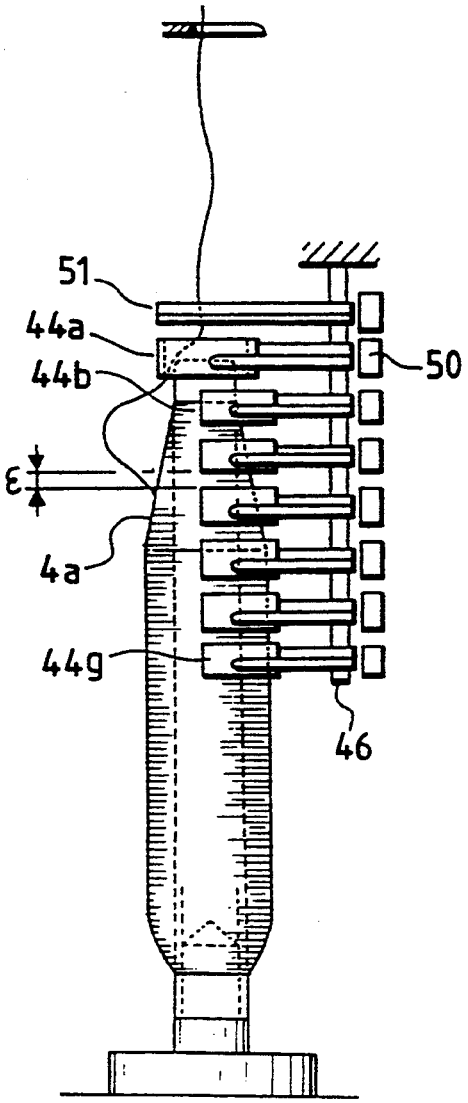
FIGS. 10*a*–10*c* are side and sectional views showing another embodiment of the first and second defining members.
Figure 10B:
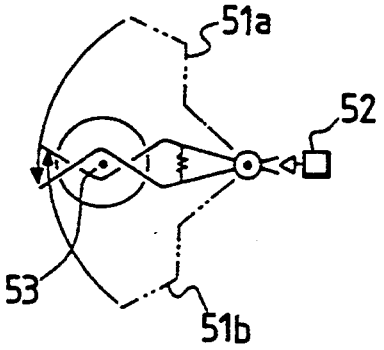
Figure 10C:
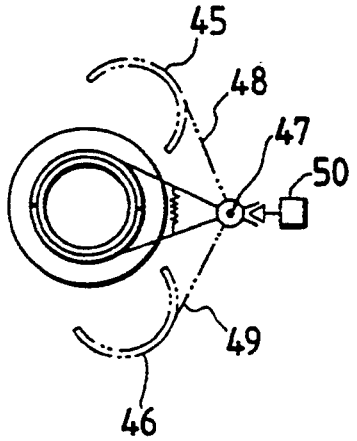

FIGS. 10*a*–10*c* show another embodiment of the first and second defining members. In FIG. 10*a*, the first defining member is composed of multistage closing tubular bodies 44*a* to 44*g* stacked leaving a clearance $\epsilon$. As shown in FIG. 10*c*, one closing tubular body has a pair of semicircular members 45 and 46.mounted on levers 48 and 49 pivotably supported on a shaft 47. When the levers 48 and 49 are closed by a drive member 50, the inner diameter defining portion for defining the lower balloon is formed. In FIG. 10*a*, only the uppermost closing tubular body 44*a* is shown in the closed operating state. The unwinding of the chase portion 4a proceeds, the closing tubular bodies 44b to 44g are closed, and the inner diameter defining portion of the closing tubular bodies 44a to 44g follow the unwinding. A sensor not shown for detecting the chase portion 4a moves down as the closing tubular bodies 44a to 44g close. The clearance $\epsilon$ between the closing tubular bodies 44a to 44g may be close to zero but a clearance $\epsilon$ to some extent is preferably provided to confirm the unwinding state of the yarn feed bobbin. The second defining member is composed of a closing lever 51. As shown in FIG. 10b, substantially V-shaped levers 51a and 51b are closed by a drive member 52 to thereby form a diamond-shaped yarn running area defining space 53. The dimension of the space 53 is set to be accommodated in the outer diameter of the top of the take-up tube 4b. The tubular body as the first defining member is not necessarily continuous in an axial direction of the yarn feed bobbin 4 but may be discontinuous. For example, a mere closing ring can be also used. Further, since the first and second defining members are of the closable construction, there is a merit that the bobbin changing and threading are easily carried out.

The unwinding assisting device in an automatic winder according to the present invention comprises a balloon defining member having a ring which is smaller than the outer diameter of a yarn layer of a yarn feed bobbin but larger than the outer diameter of a core tube, and following means for causing said ring to follow unwinding of the yarn feed bobbin. Since the yarn feed bobbin can be seen through the ring, even if the balloon defining member covered over the core tube of the yarn feed bobbin is used so as to increase the practical winding speed, the yarn feed bobbin can be easily visually confirmed.

An unwinding assisting device according to the present invention comprises a first defining member having an inner diameter defining portion covered over a yarn feed bobbin to define a lower balloon, and a second defining member having a defining member located above the yarn feed bobbin to define a yarn running area and defining an upper balloon, wherein said first defining member is separated from said second defining member to enable following the rewinding of the yarn feed bobbin. The lower balloon is defined by the first defining member to maintain the angle of unwinding from the chase portion adequately to suppress the upward movement of the unwinding tension. Therefore, it is possible to increase the winding speed without increasing the end breakages and fuzz. Moreover, the first defining member following the unwinding is separated from the second defining member positioned above the yarn feed bobbin whereby application to along bobbin is easy and even if the unwinding assisting device is applied, the winding unit is heightened.

Further, the unwinding assisting device according to the present invention may be of the device comprising a tubular body having a polygonal section of an inscribed circle which is smaller than the outer diameter of a yarn layer of a yarn feed bobbin but larger than the outer diameter of a core tube, and following means for causing said tubular body to follow unwinding of the yarn feed bobbin.

In the unwinding assisting device mentioned above, the yarn to be unwound is delivered while contacting with the inner surface of the tubular body and while helically rotating, but since the tubular body has a polygonal section, the rotation thereof is discontinuous, whereby formation of a regular node is impeded and the shape of the upper balloon is broken and becomes small.

Figure 13:
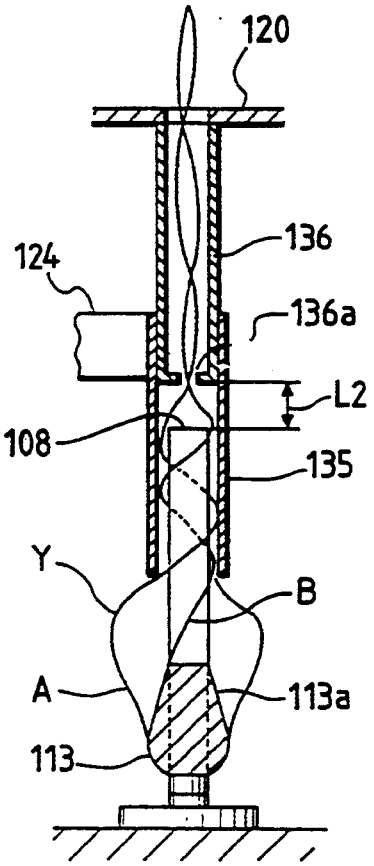
FIG. 13 is a sectional view showing essential parts and operation of an embodiment of an unwinding assisting device according to the present invention.

A further embodiment of the present invention will be described with reference to FIGS. 13 to 15. FIG. 13 is a sectional view showing essential parts and operation of the unwinding assisting device according to the present invention.

The balloon defining member according to the present invention comprises a first balloon defining member 135 and a second balloon defining member 136.

The second balloon defining member 136 is small diameter tubular body, an upper end of which is secured to a base 120 or the like, and an aperture 136a is provided at the lower end thereof. This aperture 136a is positioned substantially constant distance L2 from the top of a bobbin 108. This distance L2 is set in the range such that the aperture effect is reduced to suppress an increase of tension at the termination of winding and the outer peripheral portion of the top of the bobbin is not in contact with the running yarn That is, when the distance is excessively large, the aperture effect reduces and when it is excessively small, the running yarn contact with the outer peripheral portion of the top of the bobbin. Specifically, preferably, it is set in the range of 10 to 100 mm. The first balloon defining member 135 is a large diameter tubular body, which can be accommodated onto the second balloon defining member 136 and can be expanded in a two-stage telescopic manner. The elevating block 35 shown in FIG. 1 is mounted at a suitable place of the first balloon defining member 135 and can be moved down as the yarn feed bobbin is unwound but the position of the aperture 136a of second balloon defining member 136 remains unchanged. That is, the yarn Y raised while the balloon is defined by the first balloon defining member 135 is formed into a stable small balloon via an aperture 136a of the second balloon defining member 136 and reaches an upper point 120.

Figure 14:
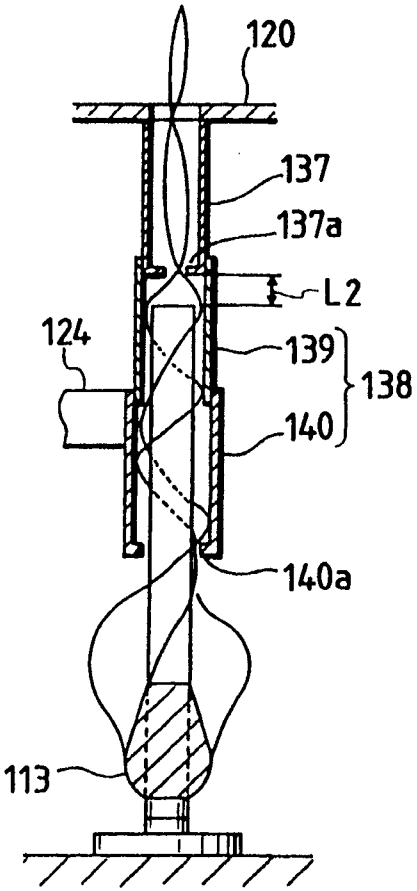
FIG. 14 is a sectional view showing an example in which a first balloon defining member and a second balloon defining member are combined.

FIG. 14 is a view showing an example in which a first balloon defining member and a second balloon defining member suitable for a long bobbin. A second balloon defining member 137 is a tubular body which is smaller in diameter than that shown in FIG. 13, and has an aperture 137a located at substantially constant distance L2 from the top of a bobbin 108. A first balloon defining member 138 comprises a middle diameter tubular body 139 and a large diameter tubular body 140. The second balloon defining member 137 can be accommodated in the middle diameter tubular body 139, and the middle diameter tubular body 139 can be accommodated in the large diameter tubular body 140 so that it can be expanded in a three-stage telescopic manner. The large diameter tubular body 140 has at its lower end a ring 140a having the same diameter as the inner diameter of the middle diameter tubular body 139 so that the balloon is not excessively spread from a yarn feed bobbin 113. The elevating block 35 shown in FIG. 1 is mounted at a suitable place of the large diameter tubular body 140, the elevating block 35 capable of being moved down as the yarn feed bobbin is unwound but the position of the aperture 137a of the second balloon defining member 137 remains unchanged. The three-telescopic one becomes short in length when contracted, and is suited for a long bobbin as shown.

Figure 16:
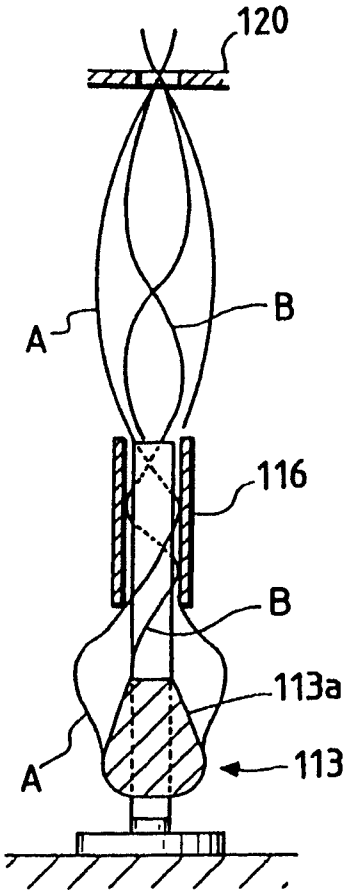
FIG. 16 PRIOR ART
FIG. 16 is an operating side view of a conventional unwinding assisting device.

The operation of the aforementioned unwinding assisting device will be described with reference to FIG. 13 showing the state near the termination of winding. In FIG. 16 showing the case of a conventional balloon guide, the yarn A unwound from the lower end of the chase 113*a* of the yarn feed bobbin 113 is formed into a balloon in the shape A till it reaches the port 120 after being moved out of the tubular body 116. The unwinding tension of the yarn unwound from the lower end of the chase 113*a* increases. On the other hand, the yarn B unwound from the upper end of the chase 113*a* is formed into a balloon in the shape B till it reaches the port 120 after being moved out of the tubular body 116. The unwinding tension of the yarn unwound from the upper end of the chase 113*a* decreases. The shape A and shape B balloons alternately occur. This state becomes remarkable in the vicinity of the termination of winding of the yarn feed bobbin 113, and as the result, as shown in FIG. 4*b*, the amplitude and mean value of the unwinding tension abruptly increase after passage of ¾ from the beginning of winding. However, in FIG. 13 in which the first balloon defining member 135 and the second balloon defining member 136 are combined, the yarn A unwound from the lower end of the chase 113*a* as well as the yarn B unwound from the upper end of the chase 113*a* is not much different from the shape of the balloon after being moved out of the aperture 136*a* of the second balloon defining member 136. As a result, as shown in FIG. 4*a*, the amplitude and mean value of the unwinding tension after passage of ¾ from the beginning of winding gradually increase and is found to be considerably improved as compared with that shown in FIG. 4*b*.

Figure 15:
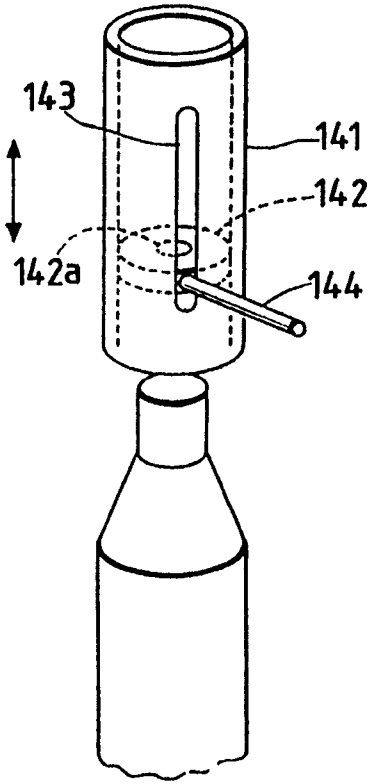
FIG. 15 is a perspective view showing another embodiment of the second balloon defining member.

FIG. 15 is a perspective view showing another embodiment of a second balloon defining member. A first balloon defining member 141 is provided with a slot 43. A disk-like second balloon defining member 142 having an aperture 142*a* is loosely inserted into the first balloon defining member 141 and is secured to a suitable place of a winding unit by a supporting rod 144 protruded from the slot 143. As described, the second balloon defining member at least has an aperture but is not necessarily a tubular body.

The above mentioned unwinding assisting device in an automatic winder according to the present invention comprises a first balloon defining member which moves down as the yarn feed bobbin is unwound and a second balloon defining member having an aperture arranged close to the top of the bobbin. The first balloon defining member defines a balloon at the time of unwinding and the second balloon defining member causes the upper balloon to be stabilized. With this, it is possible to suppress an occurrence of a yarn breakage at the termination of winding to cope with the high speed winding by the geometrical effect of the first and second defining members.

Figure 17:
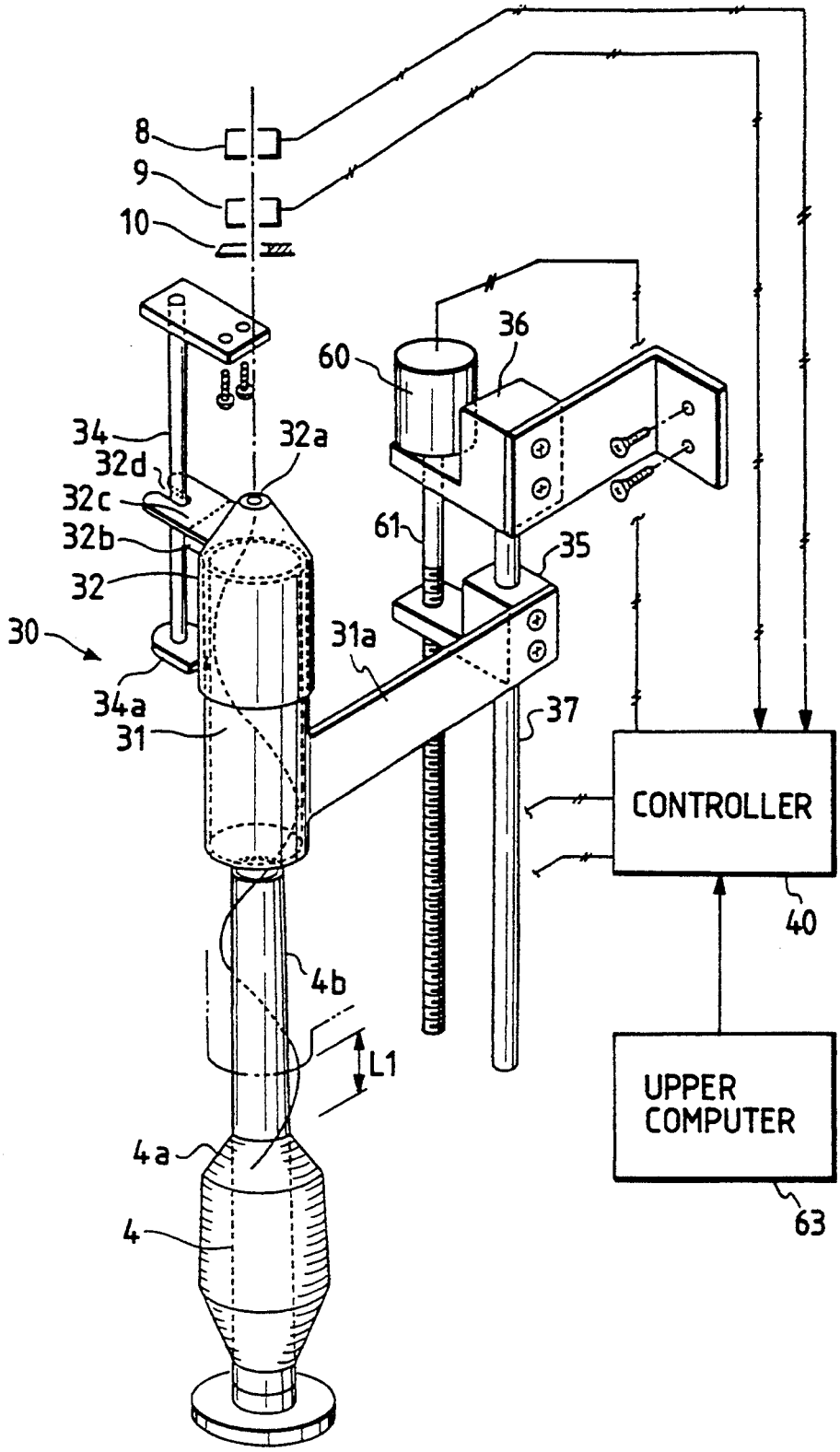
FIG. 17 is a perspective view showing another embodiment of the unwinding assisting device according to the present invention.

FIG. 17 is a view showing still another embodiment of an unwinding assisting device. FIG. 17 is different from FIG. 1 in that a motor 60 and a screw shaft 61 are used in place of the sensor 33 and the cylinder 38 so that the motor 60 is controlled by a controller 40 through an upper computer 63.

Figure 18:
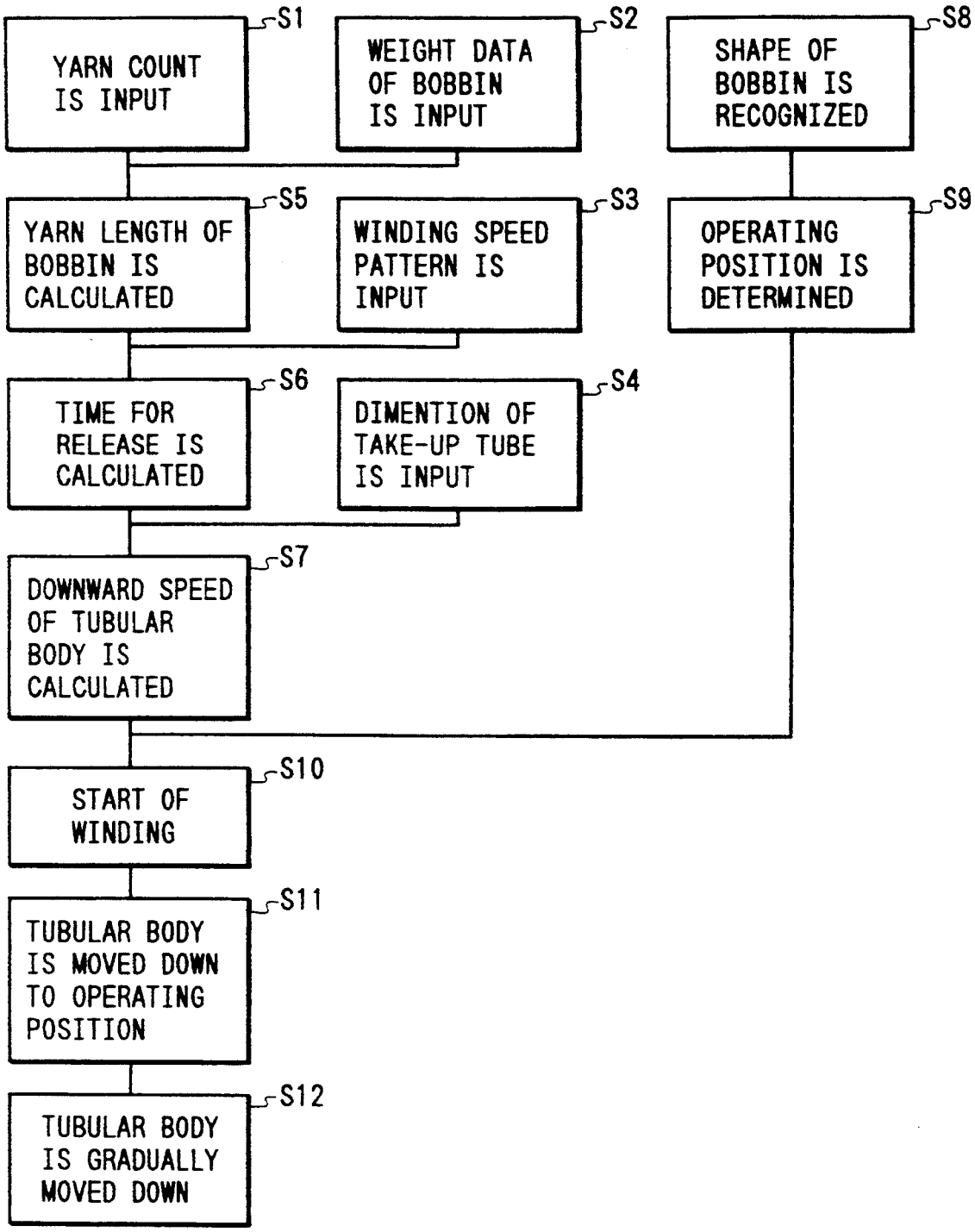
FIG. 18 is a flow chart showing the operation of the tubular body.

In FIG. 17, a tubular body 31 follows the unwinding on the basis of the rotational control of the motor 60 by the controller 40 to maintain a constant distance L1 from the chase portion 4*a*. Therefore, the upper computer 63 is connected to the controller 40 so that the downward speed of the tubular body 31 to be outputted by the controller 40 is determined. The procedure of the upper computer 63 will be described with reference to FIG. 18. First, the count of a yarn to be wound is inputted (Step S1). The weight of the yarn on the yarn feed bobbin is measured before entering the winding unit, for example, and the weight data is automatically inputted (Step S2). The thickness of the yarn layer in place of the weight data is measured by the sensor and the yarn layer data can be inputted. A winding speed pattern of the winding unit is also inputted (Step S3). The dimension of the take-up tube of the yarn feed bobbin supplied to the winding unit is also inputted (Step S4). The yarn length of the yarn feed bobbin is calculated from the count of Step S1 and weight of yarn of Step S2 (Step S5). The time required for the unwinding is calculated from the yarn length and the winding speed of Step S3 (Step S6). The downward speed of the tubular body is calculated from the unwinding time and the dimension of the take-up tube of Step S4 (Step S7).

When the partial bobbin is mixed, the operating position of the tubular body need be lowered accordingly. The operating position of the tubular body is not determined from only the aforementioned unwinding time. In Step S8, the shape of the yarn feed bobbin is recognized. For example, the height of the chase portion is detected by a sensor with transmission type photoelectric feelers arranged, and the height of the chase portion is written into a magnetic plate lined on the tray in the case of a special partial bobbin. A read device for a magnetic plate is provided on each winding unit. The operating position of the tubular body is determined by information from read device (Step S9).

The aforementioned Step S1 to 7 and Step S8 to 9 comprise the preparatory stage. When the winding starts (Step S10), the tubular body is moved down from the retreated position to the operating position (the initial operating position determined from the dimension of the take-up tube and information of Step S9) (Step S11). The tubular body is moved down at the downward speed calculated in advance at Step S7 (Step S12).

The control method for the unwinding assisting device according to the present invention comprises recognizing a position of a chase portion according to the shape of a bobbin to be supplied, and transferring a balloon defining member to the recognized position. Further, the unwinding assisting device comprises means for recognizing a position of a chase portion according to the shape of a bobbin to be supplied, and transfer means for transferring a balloon defining member to the recognized position. Even in leasing of a partial bobbin, the operating position of the balloon defining member is automatically determined, and even the partial bobbin can be coped with.

Figure 19:
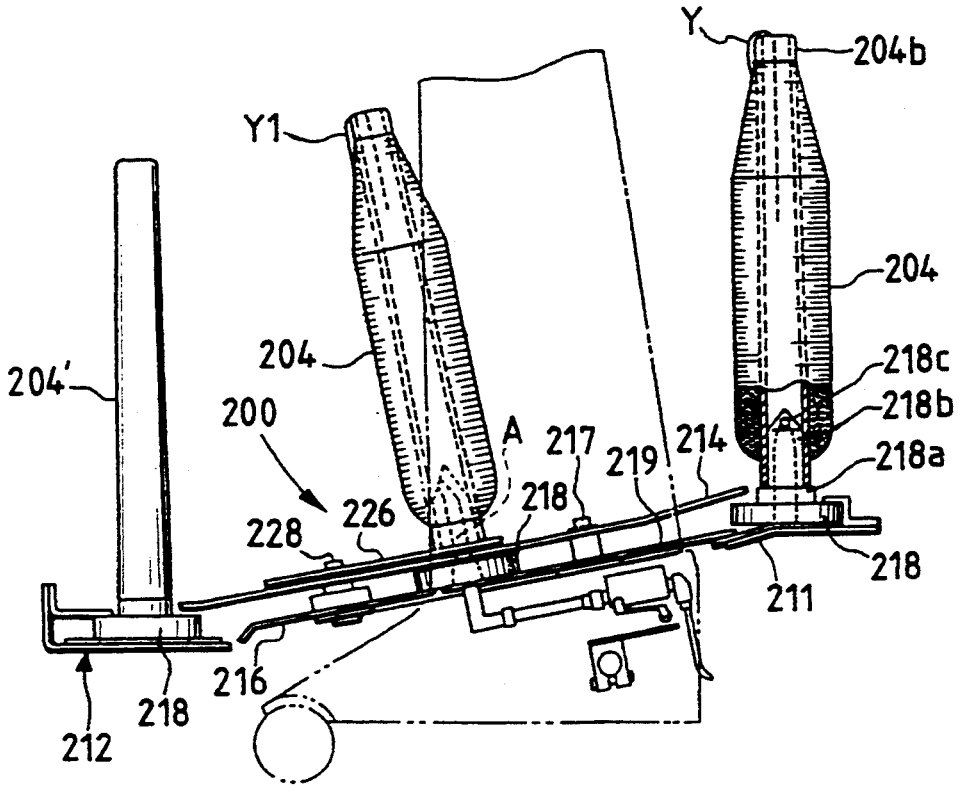
FIG. 19 is a side view showing a bobbin take-in mechanism of a winding unit.

Next, a supply device 200 for supplying a yarn feed bobbin to a winding position will be described with reference to FIGS. 19 and 20. In FIG. 19, a yarn feed bobbin 204 is stood upright on a tray 218. That is, a lower end of a take-up tube 204*b* of the yarn feed bobbin 204 is inserted into a peg 218*b* of a tray 218 and rests on a shoulder 218*b* in an upright attitude. A supply conveyor 211 and a discharge conveyor 212 are disposed so as to have a difference in vertical level therebetween, and the supply device 200 is obliquely communicated therebetween.

Figure 20:
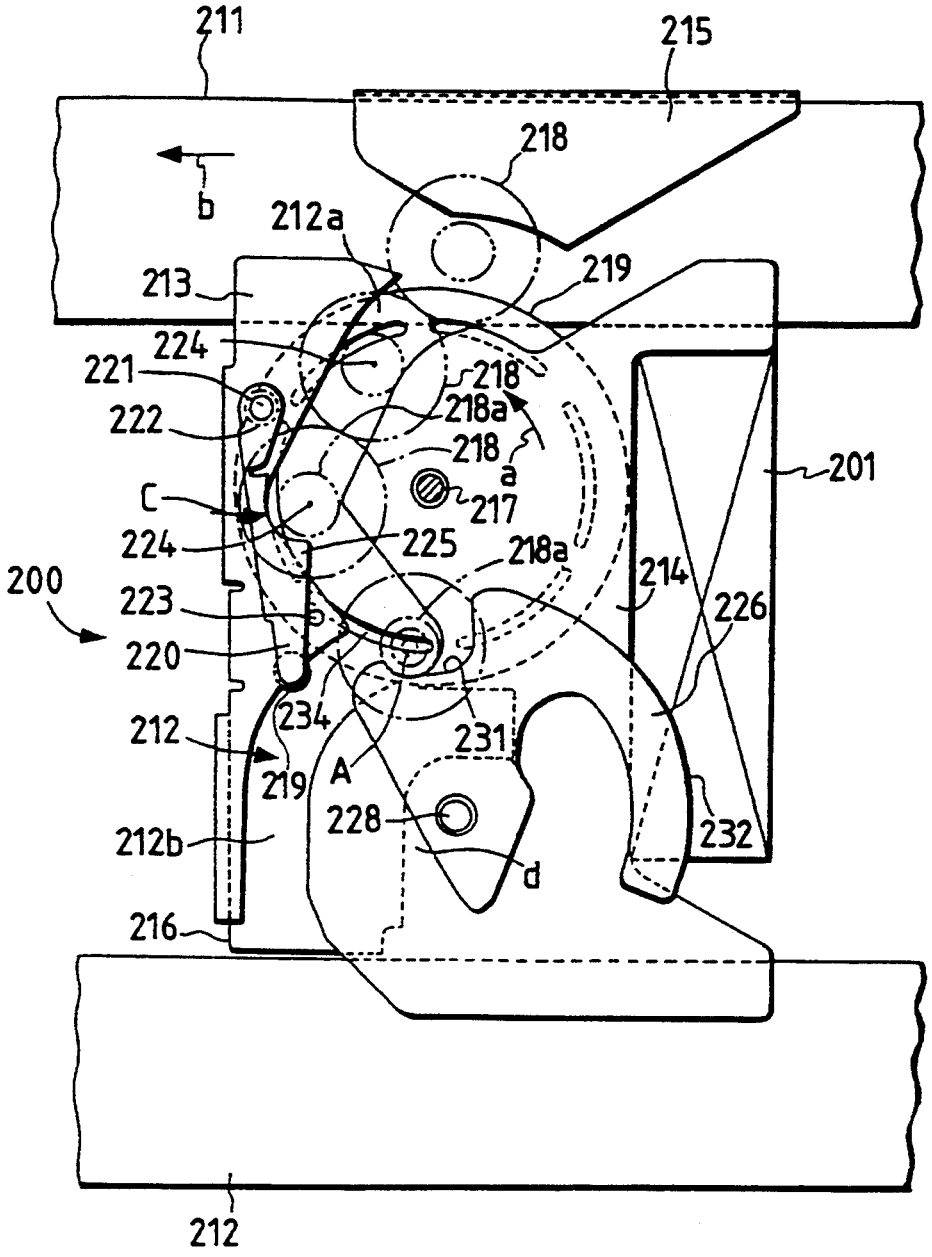
FIG. 20 is a plan view of FIG. 19.

In FIG. 20, between both the conveyors 211 and 212, a first and a second guide plates 213 and 214 which form a bended passage 212 of the tray 218 are secured to a winding unit 201. The lower surface of an in-passage 212*a* comprises a freely rotating inclined disk 219, and the lower surface of an out-passage 212*b* comprises a bottom plate 216 in which said first guide plate 213 is bended. The supply conveyor 211, the inclined disk 219, the bottom plate 216 and the discharge conveyor 212 form a mutually continuous substantially same plane, and a part of the inclined disk 219 comes into contact with the supply conveyor 211 and is applied with a turning force in a direction of arrow (a) about the shaft 217. The supply conveyor 211 is further provided with a third guide plate 215 so that when the tray 218 is not present at the stand-by position 224, the tray 218 transferred in a direction of (b) by the conveyor 211 is guided into the in-passage 212*a* and the extra trays 218 are passed.

In the first guide plate 213, a stopper 220 having a free roller 219 at the end thereof is supported on a shaft 221, the stopper 220 being rotated in a direction of (c) by a spring 222 and coming into contact with a pin 223 to suppress the rotation thereof. The stopper 220 in the state in contact with the pin 223 has a convex portion 225 wherein the first bended portion of the passage 212, namely, an outlet of the standby position 224 is allowed to be narrower than the outer diameter of the shoulder 218*a* of the tray 218 so that the tray 218 guided into the in-passage 212*a* from the supply conveyor 211 is stopped at the stand-by 224 so as to always secure two trays 218 within the in-passage 212*a*.

An ejecting lever 226 is supported on the second guide plate 214 at a shaft 228. The ejecting lever 226 has a concave portion 231 which can embrace and hold a second bended portion of the passage 212, namely, the shoulder 218*a* of the tray 218 at the winding position A, and the other end thereof comprises an arcuate roller supporting edge 232 about the shaft 228. The shaft 228 of the ejecting lever is rotated by a locking arm not shown which effect a reciprocating movement.

The operation of the aforementioned supply device 200 will be described. First, in FIG. 20 showing the normal winding state, one tray 218 and two trays 218 are positioned at the winding position A and the stand-by position 224 in the in-passage 212*a* , respectively. At that time, the first tray 218 within the winding position a stops with the shoulder 218*a* supported within the recess 231 of the ejecting lever 226, whereas the second tray 218 at the stand-by position 224 is impeded in feed by the disk 215 with the shoulder 218*a* placed in contact with the convex portion 225 of the stopper 220. When the winding of the yarn feed bobbin in the first tray 218 is completed from that state, the shaft 228 is rotated through a constant angle by a locking arm not shown. Thereby, the ejecting lever 226 turns leftward while holding the first tray 218 within the recess 231 so that the first tray 218 is discharged onto the discharge conveyor 212 from the out-passage 212*b*. As the ejecting lever 226 turns, the roller supporting edge 232 of the ejecting lever 226 comes into contact with the free roller 219 of the stopper 220 to retreat the convex portion 225 of the stopper 220 leftward. Accordingly, the second tray 218 is released from the convex portion 225, is fed by the inclined disk 215 which is always rotated by the drive force obtained by friction from the supply conveyor 211 and comes into contact with the roller supporting edge of the ejecting lever 226 and stops. Next, when the ejecting lever 226 returns to its original position, the stopper 220 returned to its original position, and the second tray 218 being stopped at the roller supporting edge 232 is fed into the recess 231 of the ejecting lever 226, namely, into the winding position A. At the same time, the yarn end Y is blown up by compressed air and gripped by the relay pipe. The piecing is then carried out.

Figure 22:
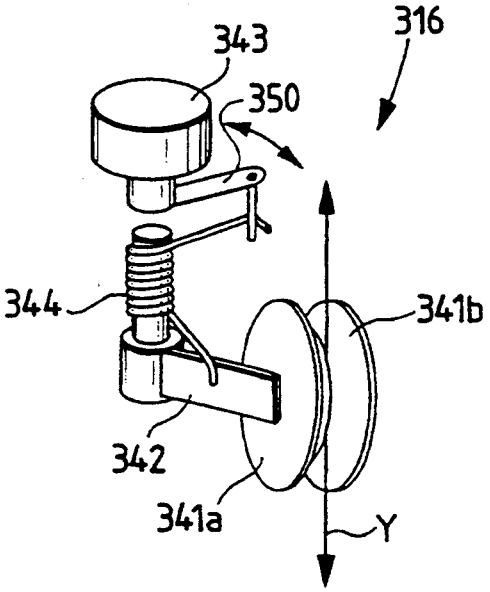
FIG. 22 is a perspective view showing one example of a device for gradually reducing tension.
Figure 23:
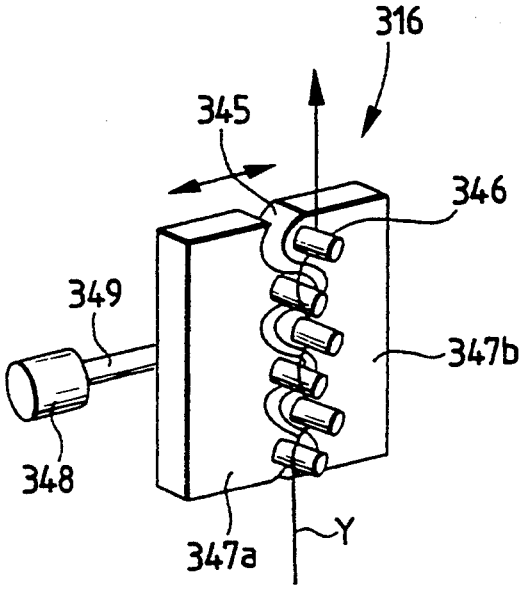
FIG. 23 is a perspective view showing another example of the same.
Figure 21:
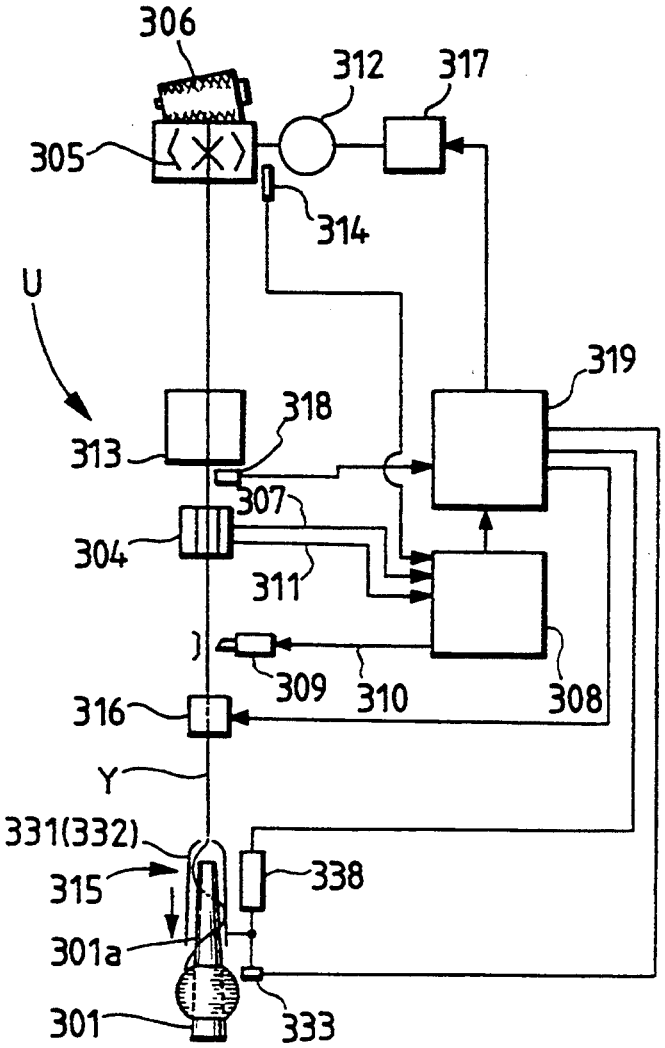
FIG. 21 is a diagrammatic view showing an arrangement of devices showing a structure of the winding unit.

FIGS. 22 and 23 are respectively perspective views of an adjustable tension device 316. The tension device 316 shown in FIG. 22 is of the type in which a yarn Y is held between two disks 341*a* and 341*b* one of which is fixed while the other is pressed thereagainst. A movable disk 341*a* is rockably supported by a supporting arm 342, and a spring 344 is suspended with both ends engaged with a rocking lever 350 which is rocked by normal and reverse rotation of a rotary solenoid 343 and a supporting arm 342 of the disk 341*a*. The rocking lever 350 is rocked by the normal and reverse rotation of the rotary solenoid 343 to increase and decrease the bias force of the spring 344 whereby varying the pressing force of two disks 341*a* and 341*b* to sequentially control the tension applied to the running yarn Y. In FIG. 21, a tension sensor 318 is designed so that for example, a piezo-electric element is provided at a position against which is pressed the yarn Y. The value of the tension sensor 318 is compared with a predetermined value by a control device 319. When the value is larger than the predetermined value, the bias force of the spring 344 is reduced to offset the increase of the unwinding tension.

The tension device 316 shown in FIG. 23 is provided on the side thereof with wavy concavo-convex surfaces 345 engaged with each other, and has gate plates 347*a* and 347*b* provided with a plurality of short rods 346 protruded at right angles to the direction of the wave at tops of the waves, and a drive mechanism 349 in which one gate plate 347*a* is moved forward and backward by rotation of a rotary solenoid 348 to adjust the engaging amount. An angle of contact with the short rod 346 is varied with respect to the yarn Y which runs in a zigzag manner on the surface of the short rod 246 by forward and backward movement of the gate 347*a* to sequentially control the added tension of the running yarn.

In FIG. 21, the winding speed adjusting device comprises an inverter 317 and a control device 319. More-specifically, in each winding unit, the rotational speed of the drive motor 312, namely, the winding speed is set to a desired curve through the invertor 317 by a control signal outputted from the control device 319 for controlling the motor to the optimum rotational speed. In the case where even the added tension of the tension device 316 is zero, the unwinding tension is increased, the winding speed is gradually reduced to suppress the unwinding tension.

Next, the variation of the unwinding tension in the case where the unwinding assisting device is used will be described with reference to FIG. 4*a* and 4*b*. FIG 4*a* an example of an embodiment of an unwinding assisting device, and FIG. 4*b* shows the case of a conventional fixed balloon breaker. In the case of the conventional balloon breaker, an increase of an unwinding tension (mean value) from the neighbourhood of a skinny bobbin is about 2 times, amplitude of which is also large. In the case of the unwinding assisting device according to the embodiment, an increase of an unwinding tension (mean value) is small, 1.5 times, amplitude of which is also small. For implementation of high speed of the winding speed, the increase itself of the unwinding tension need be eliminated.

To supplement the unwinding assisting device, the aforementioned adjustable tension device and the winding speed adjusting device are used. FIG. 24 is a graphic representation showing an example of supplement.

Figures 24A, 24B, 24C:
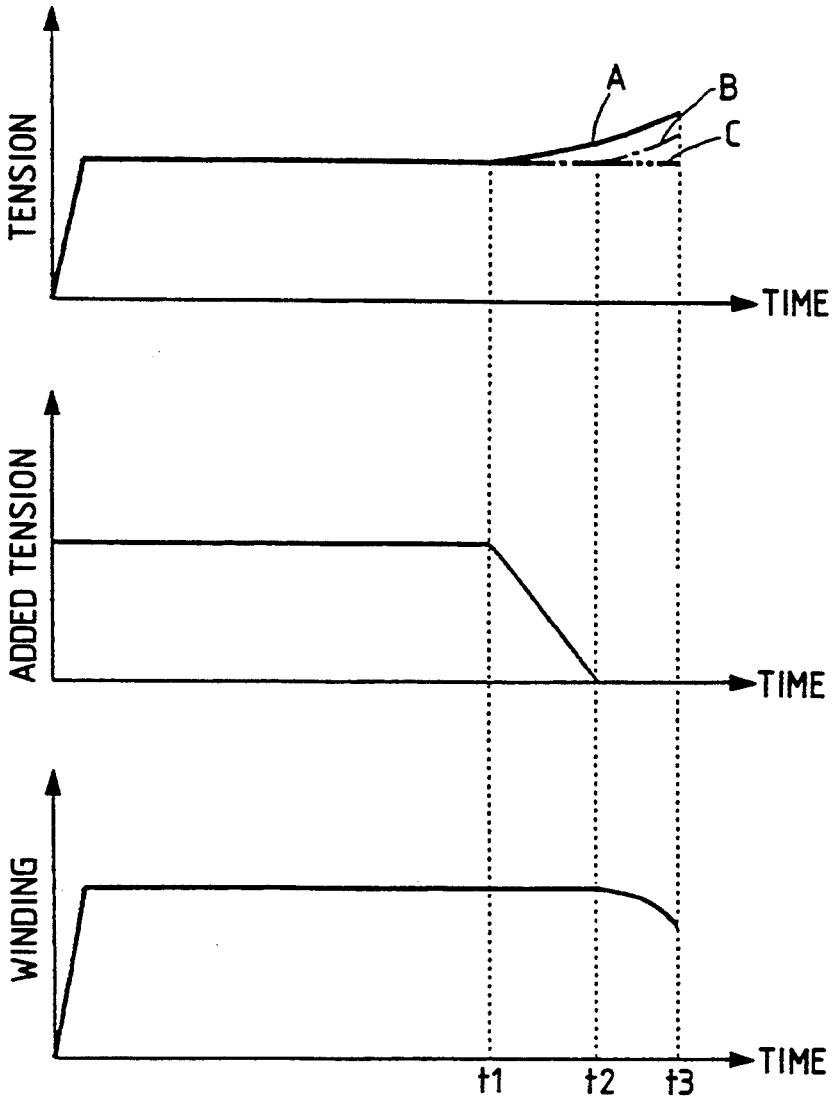
FIGS. 24*a*–24*c* are diagrams showing a variation of tension value.

FIG. 24*a*, 24*b* and 24*c* show the tension value, the value of the added tension, and the time passage of the winding speed, respectively. FIG. 24*a* shows a curve A in which the tension increased by being influenced by the increase of the unwinding tension from the time t1 in the vicinity of the skinny bobbin. In FIG. 24*b*, the value of the added tension is gradually reduced during the time t1 to t2, and value of the tension in FIG. 24*a* is made to assume a curve B. However, the added tension by the tension device is zero at the time t2, and further adjustment is impossible. In FIG. 24*c*, the winding speed is gradually reduced during the time t2 to t3 so that the tension value of FIG. 24*a* is made to have a curve C. In this manner, the tension device and winding speed adjusting device are used to assist the unwinding assisting device and the increase of the tension value is suppressed. Therefore, the device can be coped with the high speed winding.

While in the aforementioned description, the case has been described in which both the tension device and the winding speed adjusting device are used to assist the unwinding assisting device, it is to be noted that either one can be used to assist it. Further, while the case has been described in which the tension sensor is used to control the tension device and the winding speed adjusting device, it is to be noted that in place of the tension sensor, the operating timing of the tension device and the winding speed adjusting device is determined by the winding length, and the degree of the operation is inputted in advance.

The winding unit of this embodiment in an automatic winder according to the present invention is provided with an unwinding assisting device covered over a take-up tube of a yarn feed bobbin to follow the unwinding, in addition to means for gradually reducing tension by an adjustable tension device or/and a winding speed control device. The increase in the unwinding tension is lessened by the unwinding assisting device and the adjustment by means for gradually reducing tension is minimized whereby the practical winding speed can be increased. As the result, the adjusting range of the tension device can be effectively utilized, and the lowering of productivity caused by the use of the winding speed adjusting device can be decreased.

Another embodiment of the present invention will be described.

Figure 25:
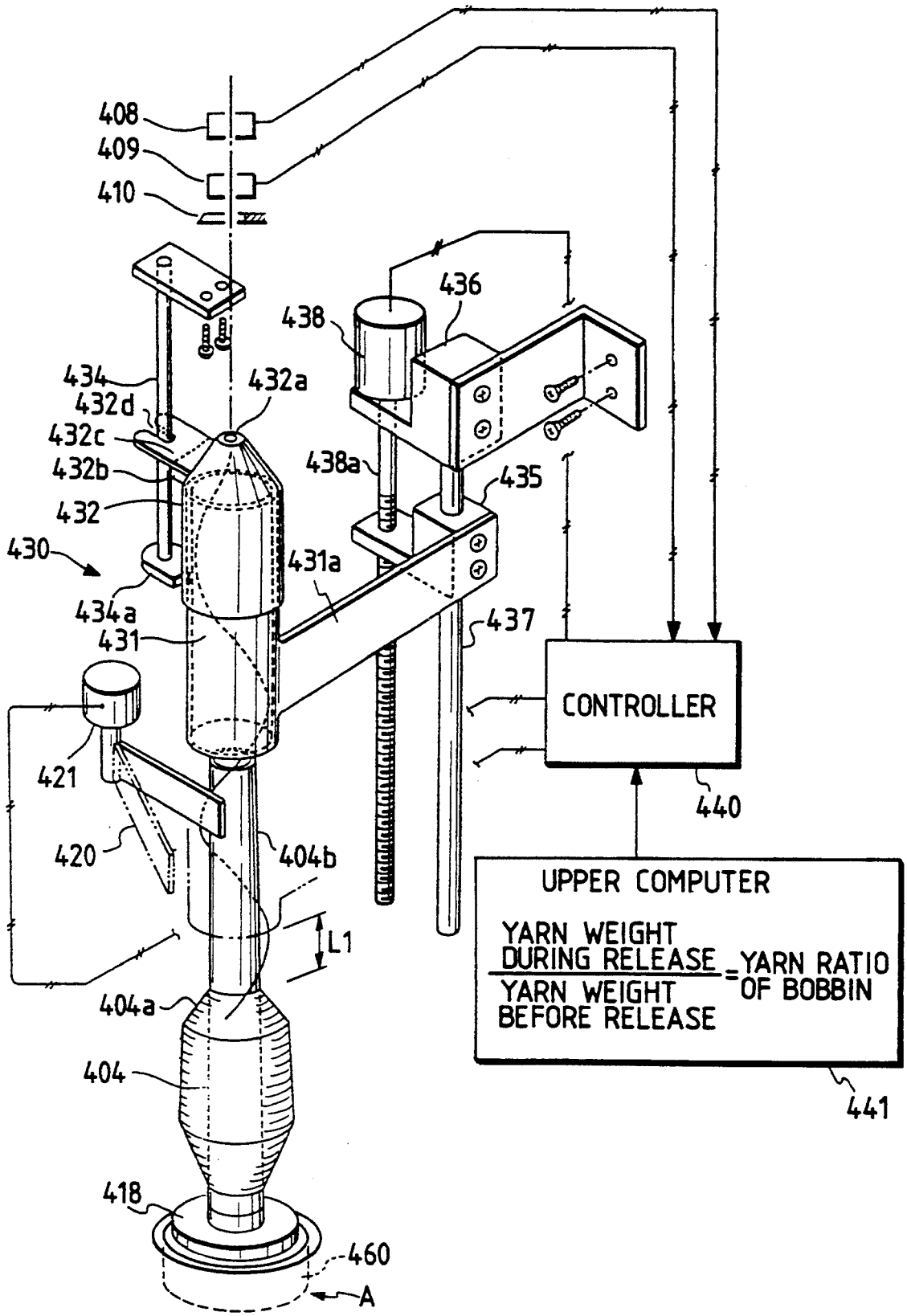
FIG. 25 is a perspective view showing another embodiment of the unwinding assisting device according to the present invention.

In FIG. 25, the aforementioned tubular body 431 follows the unwinding on the basis of the rotational control of the motor 438 by the controller 440 so as to maintain the constant distance L1 from the chase portion 404*a*. The upper computer 441 controls the controller 440. A load cell 460 is embedded in the winding position A, and the measured value indicative of a variation of total weight resulting from the unwinding of the yarn feed bobbin 404 supplied to the winding position A is inputted into the controller 440. The known weight of the take-up tube 404*b* and the tray 418 is inputted into the upper computer 441, and when the known weight is subtracted, the yarn weight before the unwinding is calculated. As the unwinding proceeds, the yarn weight during the unwinding is sequentially calculated, and how the yarn amount of bobbin is now is recognized from (yarn weight during unwinding/yarn weight before unwinding). On the basis of this information, the controller 440 controls the rotation of the motor 438 to maintain substantially constant the distance L1 between the inner diameter defining portion at the lower end of the tubular body 431 and the chase portion.

Figure 26:
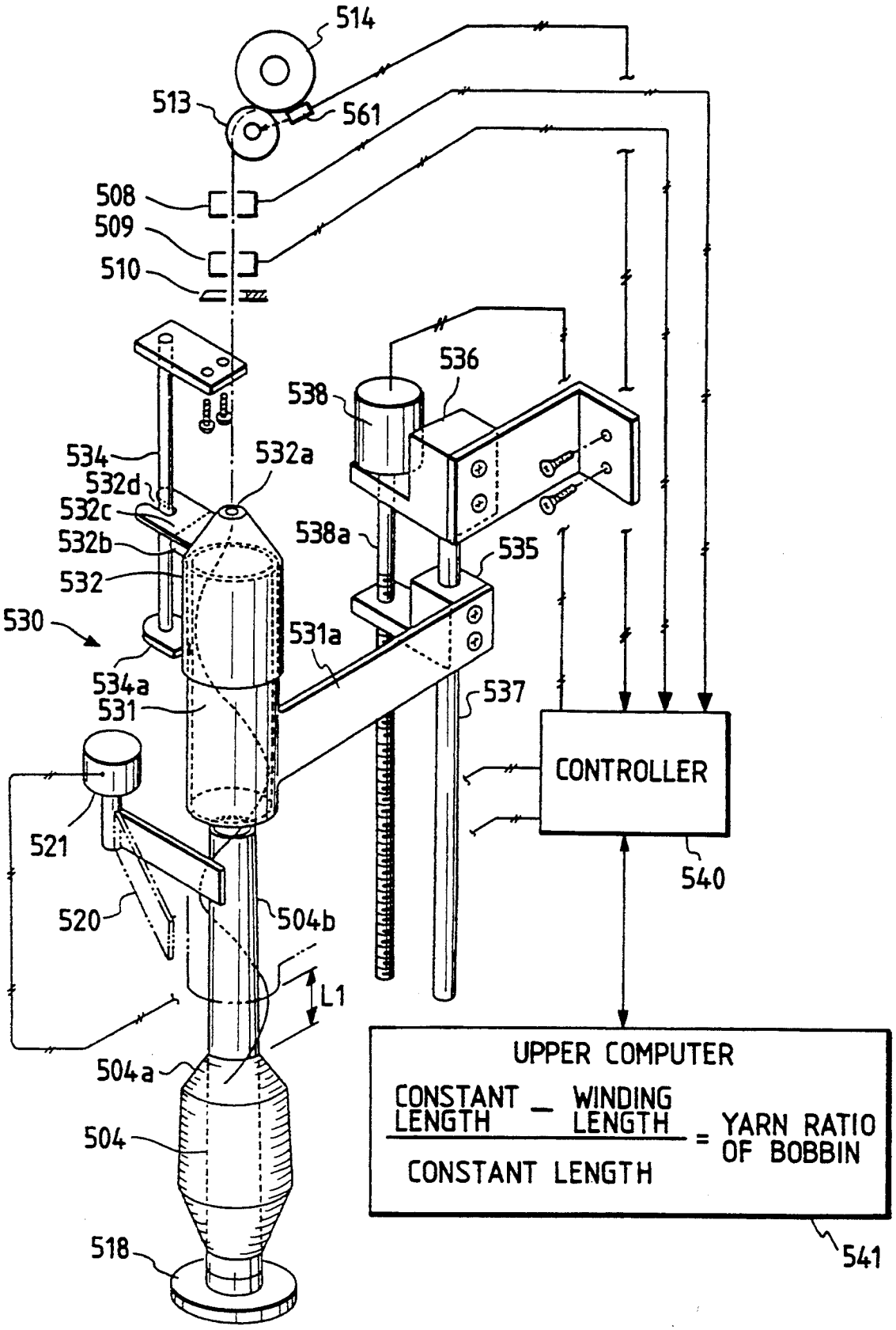
FIG. 26 is a perspective view showing another embodiment of the present invention.

FIG. 26 is a view showing a method for measuring a yarn length instead of the load cell shown in FIG. 25. A sensor 561 measures the number of revolutions of a traverse drum 513, the sensor 561 being connected to a controller 540. The winding length from a yard feed bobbin 504 is measured by the sensor 561. A yarn length of the yarn feed bobbin 504 is inputted in advance in an upper computer 541, and how the yarn amount of bobbin is now is recognized from (initial yarn length-wound yarn length)/initial yarn length. On the basis of this information, the controller 540 controls the rotation of a motor 538 to maintain substantially constant the length L1 between the inner diameter defining portion at the lower end of the tubular body 531 and the chase portion.

Figure 27:
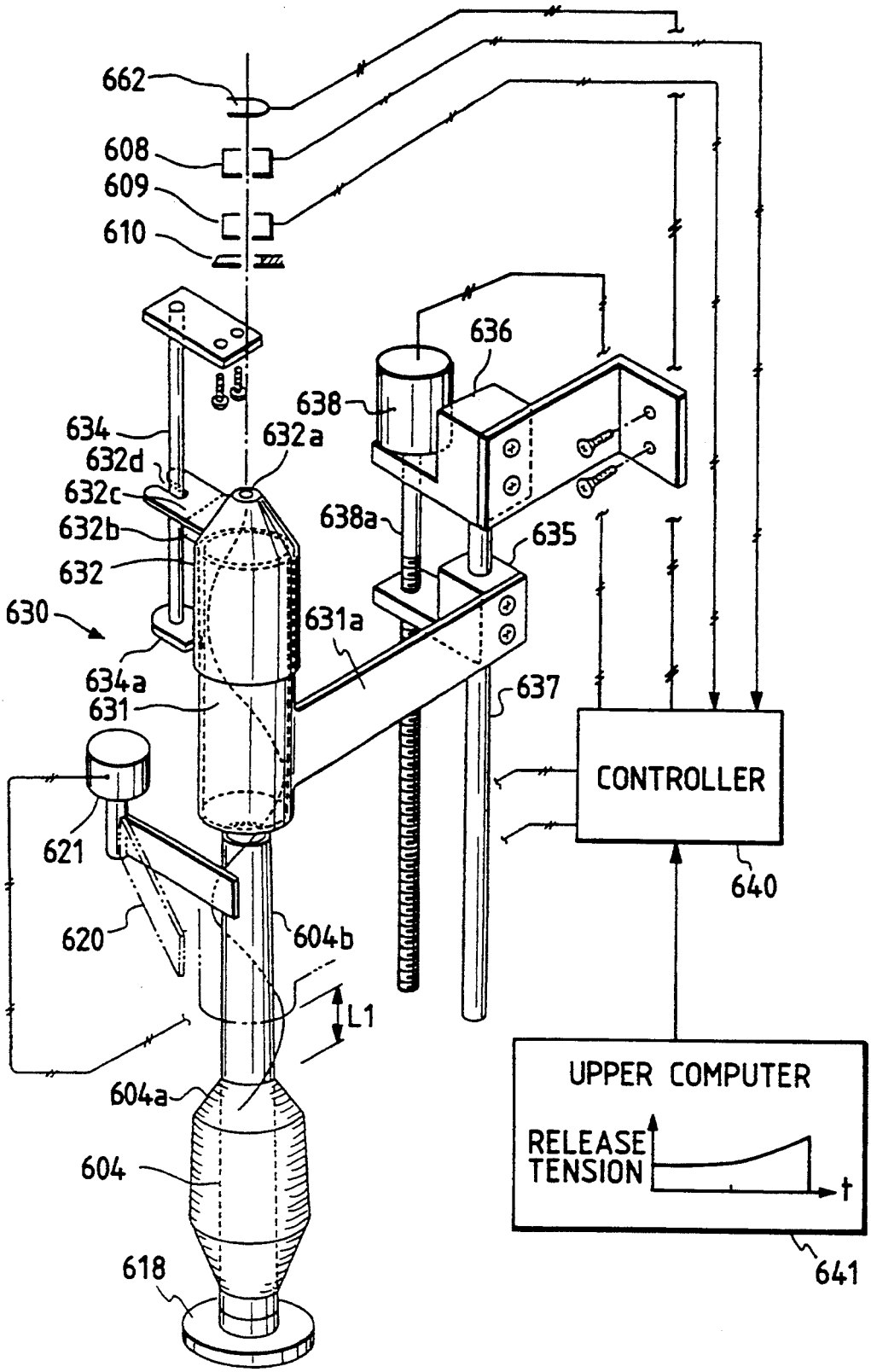
FIG. 27 is a perspective view showing still another embodiment of the present invention.

FIG. 27 is a view showing a method using the measurement of unwinding tension in place of the load cell shown in FIG. 25. A yarn tension sensor 662 measures an unwinding tension, the yarn tension sensor 662 being connected to a controller 640. A variation of the unwinding tension during the unwinding is measured by the yarn tension sensor 662. In general, the unwinding tension increases as the unwinding proceeds. A changing curve of the unwinding tension in the specific yarn feed bobbin is inputted in advance, and how the yarn amount of bobbin is now is recognized by comparison between the curve and the present unwinding tension. On the basis of this information, the controller 640 controls the rotation of a motor 638 to maintain substantially constant the distance L1 between the inner diameter defining portion at the lower end of the tubular body 631 and the chase portion. It is noted that in place of the yarn tension sensor 662, a ring-like piezo-electric element is attached to the inner diameter defining portion of the tubular body 631 so that contact pressure of the yarn to be unwound is measured, and the present balloon can be also discriminated by the variation of the contact pressure.

Next, still further embodiment of an unwinding assisting device will be illustrated. There is provided an unwinding assisting device comprising a tubular body inserted onto a core tube so as to limit a balloon of a yarn to be unwound from a yarn feed bobbin, said tubular bobbin having upper and lower ends opened, and means for downwardly moving a tubular body for downwardly moving the tubular body according to the unwinding of the yarn, wherein said tubular body is provided at the upper end thereof with an aperture.

The aperture at the upper end of the tubular body stabilizes the balloon of the upper yarn irrespective of the downward movement of the tubular body.

Figure 28:
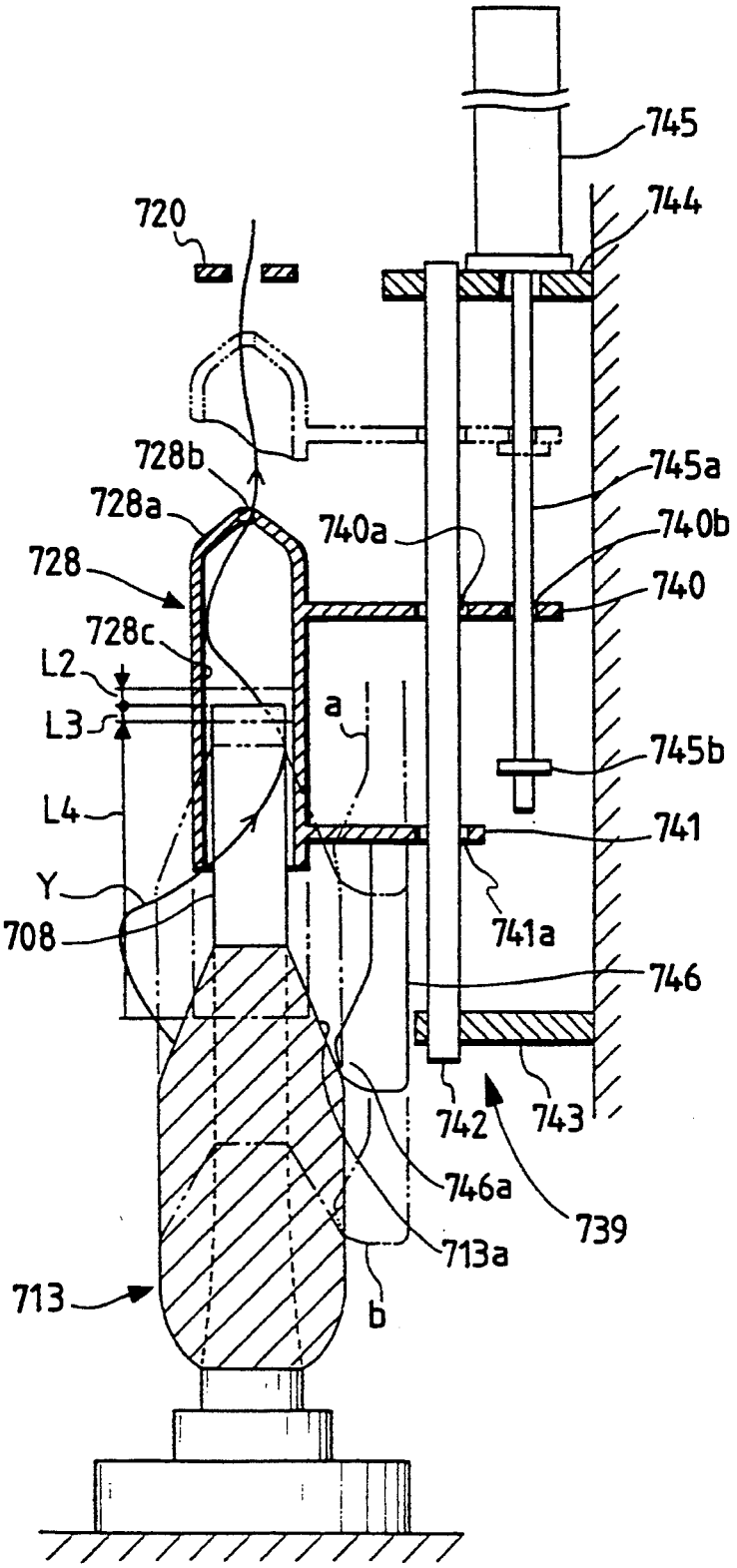
FIG. 28 is a sectional view showing a further embodiment of the unwinding assisting device according to the present invention.

FIG. 28 is a sectional view showing an unwinding assisting device according to this embodiment of the present invention.

A tubular body 728 as a balloon breaker has a conical portion 728*a* at the upper portion thereof, and a small opening 728*b* is provided at the top of the conical portion 728*a*. This opening 728*b* forms an aperture at the upper end of the tubular body 728. That is a yarn Y raised while the balloon is defined by an inner surface 728*c* of the tubular body 728 is once changed in direction to the neighbourhood of a center axis of the tubular body 728, after that, it reaches an upper port 720.

Figure 29A:
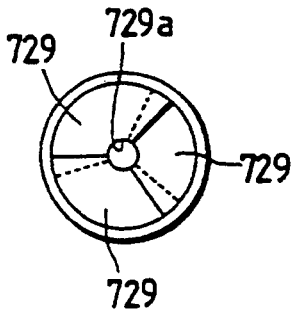
FIGS. 29*a* and 29*b* are side and sectional views showing another aperture of the tubular body.
Figure 29B:
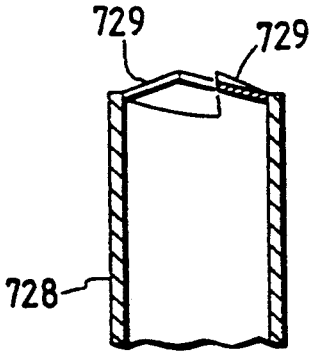

The aperture 728*b* will suffice to be one which changes the direction of the yarn Y moved out of the tubular body 728 to the neighbourhood of the center axis of the tubular body 728. Various shapes of the aperture are employed. FIG. 29 is a view showing another aperture suitable for threading. Three blades 729 are stacked on the upper end of the tubular body 728 leaving a clearance in a vertical direction, and three blades 729 cooperate to form a small opening (aperture) in its center. When a yarn end of a new yarn feed bobbin is blown up to a relay pipe, a yarn end is positively blown up by an air current passing through the clearance in the stacked portion of the blades 729.

Figure 30A:
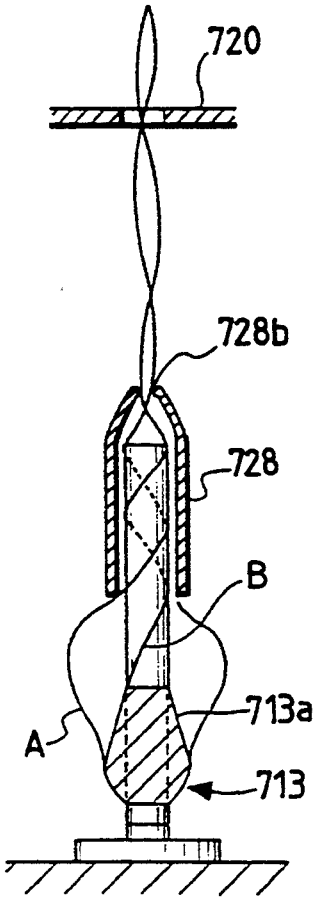
FIGS. 30*a* and 30*d* are sectional side views showing the operation of the aperture of the tubular body.
Figure 30B:
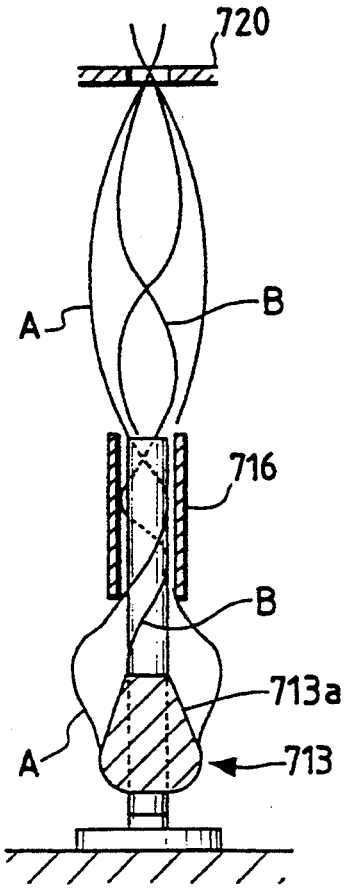
FIG. 30b PRIOR ART

Next, the operation of the aperture of the aforesaid tubular body will be described with reference to FIG. 30 showing the state where winding is about to terminate. In FIG. 30*b* showing the case of a conventional tubular body 716 without an aperture, a yarn A unwound from the lower end of a chase 713*a* of a yarn feed bobbin 713 is formed into a balloon in the shape A up to a port 720 after being moved out of the tubular body 716. An unwinding tension of the yarn unwound from the lower end of the chase 713*a* increases. On the other hand, a yarn B unwound from the upper end of the chase 713*a* is formed into a balloon in the shape B up to the port 720 after being moved out of the tubular body 716. An unwinding tension of the yarn unwound from the upper end of the chase 713*a* decreases. The shape A and shape B balloons alternately occur. This state becomes remarkable at the termination of winding of the yarn feed bobbin 713, and as the result, as shown in FIG. 4*b*, the amplitude and mean value of the unwinding tension abruptly increases from the passage of ¾ from the beginning of winding. However, in FIG. 4*a* showing the case of a tubular body 728 provided with an aperture 728*a*, the yarn A unwound from the lower end of the chase 713*a* as well as the yarn B unwound from the upper end of the chase 713*a* has not much difference in shape of balloon after having moved out of the aperture 728*a* of the tubular body 728. As the result, as shown in FIG. 4*a*, the amplitude and mean value of the unwound tension gradually increase from the passage of ¾ from the beginning of winding and found to be considerably improved as compared with FIG. 4*b*. FIGS. 4*a* and 4*b* are based on experimental data in the case where cotton yarn of count No. 40 is wound at 1500 m/min.

Turning again to FIG. 28, a preferable tubular body descending mechanism 739 will be described. Two horizontal supporting members 740 and 741 are secured to a tubular body 728, the supporting member 740 having two sliding holes 740*a* and 740*b*, the supporting member 741 having one sliding hole 741*a*. A guide shaft 742 is stood upright through brackets 743 and 744 along a yarn feed bobbin 713, and a pneumatic cylinder 745 has its rod 745*a* fixed mounted parallel with the guide shaft 742. The tubular body 728 can be moved downward by its own weight by the sliding holes 740*a* and 741*a* fitted in the guide shaft 742. The vertical limit position of the tubular body 728 is determined by the sliding hole 740*b* fitted in the rod 745*a* and a ring 745*b* at the end of the sliding hole 740*b*. A stopper member 746 is hung on the supporting member 741, and a projection 746*a* on the side of the stopper member 46 impinges upon the lower portion of the chase 713*a* of the yarn feed bobbin 713. That is, even when the yarn feed bobbin 713 is unwound, the distance between the lower end of the tubular body 728 and the chase 713*a* is maintained substantially constant.

Next, the operation of the aforementioned tubular body descending mechanism 739 will be described When the rod 745*a* of the pneumatic cylinder 745 is moved up, the supporting member 740 is raised by the ring 745*b*, and the distance from the upper end of the take-up tube 708 to the lower end of the tubular body 728 assumes an upper limit position at L2. In this state, the bobbin is replaced by a new yarn feed bobbin. Next, the rod 745*a* of the pneumatic cylinder 745 is moved down to the position indicated by the solid line. The stopper member 746 indicated by the phantom line impinges upon the lower portion of the chase or the yarn subjected to balloon to assume a start state where the lower end of the tubular body 728 covered over the take-up tube 708 by the distance L3. As the unwinding of the yarn feed bobbin 713 proceeds, the tubular body 728 is moved down by its own weight, and the distance from the lower end of the tubular body 728 to the chase 713*a* is maintained substantially constant. In the state where the stopper member 746 indicated by the phantom line (b) impinges upon the lower portion of the chase at the termination of winding or the ballooning yarn, the supporting member 740 impinges upon ring 745*b* of the rod 745*a* to assume the lower limit position. All the remaining yarn on the yarn feed bobbin 713 is unwound. As compared with the tubular body descending mechanism in the unwinding assisting device shown in FIG. 1, the drive source and the measuring device such as a sensor are not necessary, and the tubular body can be moved down according to the degree of unwinding by a simple construction.

In the unwinding assisting device mentioned above, the aperture is provided on the upper end of the descending tubular body. Even when the tubular body moves down to change the length of the upper yarn, the aperture causes the balloon of the upper yarn particularly from the tubular body to be stabilized, and the variation of the amplitude of the unwinding tension and absolute value is lessened. The limitation of the balloon at the termination of winding can be positively carried out by the geometrical effect of the descending tubular body and the aperture, and the rate of occurrence of sloughing and end breakages at the time of termination of winding can be further lowered.

What is claimed is:

1. A device for assisting the unwinding of yarn from a bobbin in an automatic winder, the bobbin comprising a take-up tube and defining a top end and the yarn on the bobbin defining a chase portion, the device comprising:

a first member, means for maintaining a substantially constant distance between the chase portion and the first member at least a portion of the yarn on the bobbin is unwound, and a second member having an aperture provided at a position above the top end of the bobbin.

2. The device as in claim 1, wherein a balloon of yarn is formed as the yarn on the bobbin is unwound and wherein at least on of the first member and the second member defines a substantially tubular body for covering at least a portion of the take-up tube and for controlling the balloon as at least a portion of the yarn on the bobbin is unwound.

3. The device as in claim 2, wherein the bobbin defines a yarn layer having an outer diameter, wherein the take-up tube defines an outer diameter, wherein the first member defines an inner diameter, and wherein the inner diameter of the first member is larger than the outer diameter of the take-up tube and smaller than the outer diameter of the yarn layer.

4. A device for assisting the unwinding of yarn from a bobbin in an automatic winder, the bobbin comprising a take-up tube and defining a top end and the yarn on the bobbin defining a chase portion, the device comprising:

a first member, means for maintaining a substantially constant distance between the chase portion and the first member as at least a portion of the yarn on the bobbin is unwound, and a second member having an aperture provided at a position above the top end of the bobbin, wherein a balloon of yarn is formed as the yarn on the bobbin is unwound and wherein at least one of the first member and the second member defines a substantially tubular body for covering at least a portion of the take-up tube and for controlling the balloon as at least a portion of the yarn on the bobbin is unwound, and wherein the top end of the bobbin and the aperture of the second member define a relative spacing, and wherein the relative spacing between the top end of the bobbin and the aperture of the second member is maintained at a distance of approximately 8 mm to 150 mm as at least a portion of the yarn on the bobbin is unwound.

5. A device for assisting the unwinding of yarn from a bobbin in an automatic winder, the bobbin comprising a take-up tube and defining a top end and the yarn on the bobbin defining a chase portion, the device comprising:

a first member, means for maintaining a substantially constant distance between the chase portion and the first member as at least a portion of the yarn on the bobbin is unwound, and a second member having an aperture provided at a position above the top end of the bobbin, wherein a balloon of yarn is formed as the yarn on the bobbin is unwound and wherein the take-up tube defines an outer diameter, the first member defining an inner portion for covering at least a portion of the take-up tube and for controlling the balloon as at least a portion of the yarn on the bobbin is unwound, the inner portion of the first member having a diameter that is larger than the outer diameter of the take-up tube, the second member being positioned above the bobbin and defining a yarn running area and a balloon above the bobbin, the balloon above the bobbin having a diameter that is smaller than the inner diameter of the first member.

6. A method for assisting the unwinding of yarn from a bobbin in an automatic winder, the yarn on the bobbin defining a chase portion, the method comprising:

providing a first member having an inner diameter, maintaining a substantially constant distance between the first member and the chase portion as at least a portion of the yarn on the bobbin is unwound, using the first member for covering at least a portion of the bobbin and for defining a lower balloon of yarn unwound from the bobbin, providing a second member having an aperture, and using the second member for defining, above the bobbin, an upper balloon of yarn unwound from the bobbin.

7. A device for assisting the unwinding of yarn from a bobbin in an automatic winder, the device comprising:

a first member having an inner diameter for covering over at least a portion of the bobbin and for defining a lower balloon of yarn unwound from the bobbin, and a second member having an aperture and being located above the bobbin for defining a yarn running area and for defining an upper balloon of yarn unwound from the bobbin, wherein the first member and the second member are separated by at least a minimum distance.

8. The device as in claim 7, wherein the yarn on the bobbin defines a chase portion, wherein the second member defines a yarn running area, and further comprising:

means for maintaining a substantially constant distance between the chase portion and the first member as at least a portion of the yarn on the bobbin is unwound.

9. The device as in claim 8, wherein the first member comprises a sensor for detecting the chase portion and wherein the means for maintaining a substantially constant distance between the chase portion and the first member is responsive to the sensor.

10. The device as in claim 9, wherein the first member defines a retreated position and further comprising means for returning the first member to the retreated position.

11. The device as in claim 9, wherein the sensor comprises a diffusion reflective sensor.

12. A method for reducing kinking during piecing in an automatic winder, the winder comprising a piecing device provided between a yarn unwound from a bobbin on a winding package and a balloon breaker, the method comprising:

providing a retractable lever, moving the balloon breaker upward from a predetermined position at the time of piecing, and bringing the lever into contact with the top of the bobbin at the time of piecing, whereby tension is applied by the lever to the yarn as the yarn is unwound from the bobbin.

13. A method for assisting the unwinding of yarn from a bobbin in an automatic winder, the automatic winder defining a progressively increasing winding speed during the unwinding, the yarn on the bobbin defining a chase portion, the method comprising:

providing a balloon defining member at a retreated position, moving the balloon defining member from the retreated position to an operating position at which a substantially constant distance is maintained between the balloon defining member and the chase portion as at least a portion of the yarn on the bobbin is unwound, and maintaining the balloon defining member in the predetermined position until the winding speed reaches a speed at which a yarn breakage occurs.

14. A method for assisting the unwinding of yarn from a bobbin in an automatic winder, the yarn on the bobbin defining a chase portion, the method comprising:

providing a balloon defining member at a retreated position, detecting a yarn running signal, moving the balloon defining member from the retreated position to an operating position in response to the detected yarn running signal, and maintaining a substantially constant distance between the balloon defining member and the chase portion as at least a portion of the yarn on the bobbin is unwound.

15. A method for assisting the unwinding of yarn from a bobbin in an automatic winder, the yarn on the bobbin defining a chase portion, the method comprising:

providing a balloon defining member, moving the balloon defining member to a retreated position, supplying the bobbin to an unwinding position defined by the winder, moving the balloon defining member to a predetermined operating position after the bobbin is supplied to the winder, maintaining a substantially constant distance between the balloon defining member and the chase portion as at least a portion of the yarn on the bobbin is unwound, detecting the absence of yarn being unwound from the bobbin, and moving the balloon defining member to the retreated position in response to the detection of the absence of yarn.

* * * * *